US009093063B2

(12) United States Patent
Vilkamo et al.

(10) Patent No.: US 9,093,063 B2
(45) Date of Patent: Jul. 28, 2015

(54) APPARATUS AND METHOD FOR EXTRACTING A DIRECT/AMBIENCE SIGNAL FROM A DOWNMIX SIGNAL AND SPATIAL PARAMETRIC INFORMATION

(75) Inventors: Juha Vilkamo, Nuremberg (DE); Jan Plogsties, Erlangen (DE); Bernhard Neugebauer, Erlangen (DE); Juergen Herre, Buckenhof (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 369 days.

(21) Appl. No.: 13/546,048

(22) Filed: Jul. 11, 2012

(65) Prior Publication Data

US 2012/0314876 A1 Dec. 13, 2012

Related U.S. Application Data

(63) Continuation of application No. PCT/EP2011/050265, filed on Jan. 11, 2011.

(60) Provisional application No. 61/295,278, filed on Jan. 15, 2010.

(30) Foreign Application Priority Data

Aug. 26, 2010 (EP) ..... 10174230

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ..... H04S 3/02; H04S 3/008; H04S 2420/03; G10L 19/008
USPC ..... 381/2, 15–19, 20–23, 94.1, 1
See application file for complete search history.

(56) References Cited

U.S. PATENT DOCUMENTS 7,567,845 B1 7/2009 Avendano et al.
8,781,133 B2 * 7/2014 Walther et al. ..... 381/17

(Continued)

FOREIGN PATENT DOCUMENTS

CN 1264264 A 8/2000
EP 1 761 110 A1 3/2007

(Continued)

OTHER PUBLICATIONS

Official Communication issued in corresponding Japanese Patent Application No. 2012-548400, mailed on Sep. 25, 2013.

(Continued)

*Primary Examiner* — Curtis Kuntz
*Assistant Examiner* — Julie X Dang
(74) *Attorney, Agent, or Firm* — Keating & Bennett, LLP

(57) ABSTRACT

An apparatus for extracting a direct and/or ambience signal from a downmix signal and spatial parametric information, the downmix signal and the spatial parametric information representing a multi-channel audio signal having more channels than the downmix signal, wherein the spatial parametric information has inter-channel relations of the multi-channel audio signal, is described. The apparatus has a direct/ambience estimator and a direct/ambience extractor. The direct/ambience estimator is configured for estimating a level information of a direct portion and/or an ambient portion of the multi-channel audio signal based on the spatial parametric information. The direct/ambience extractor is configured for extracting a direct signal portion and/or an ambient signal portion from the downmix signal based on the estimated level information of the direct portion or the ambient portion.

18 Claims, 18 Drawing Sheets

(APPARATUS FOR EXTRACTING A DIRECT/AMBIENCE SIGNAL)

(56) References Cited

U.S. PATENT DOCUMENTS

| | | | |
|---|---|---|---|
| 2007/0236858 | A1 | 10/2007 | Disch et al. |
| 2009/0198356 | A1 | 8/2009 | Goodwin et al. |

FOREIGN PATENT DOCUMENTS

| | | | | | |
|---|---|---|---|---|---|
| JP | 2009-531724 | A | | 9/2009 | |
| WO | 2005/101905 | A1 | | 10/2005 | |
| WO | WO 2005101905 | A1 | * | 10/2005 | ..... H04S 3/00 |
| WO | 2007/110101 | A1 | | 10/2007 | |

OTHER PUBLICATIONS

Norimatsu, "Low Bit Rate High Sound Quality Multi-Channel Audio Encoding Technique", MPEG Surround Panasonic Technical Publication, vol. 54, No. 4, Jan. 15, 2009, 6 pages.

Official Communication issued in corresponding Chinese Patent Application No. 201180014038.9, mailed on Aug. 2, 2013.

Official Communication issued in International Patent Application No. PCT/EP2011/050265, mailed on Mar. 15, 2011.

Goodwin et al., "Primary-Ambient Signal Decomposition and Vector-Based Localization for Spatial Audio Coding and Enhancement," IEEE Intl. Conf. on Acoustics, Speech and Signal Proc, Apr. 2007, pp. I-9 to I-12.

Merimaa et al., "Correlation-Based Ambience Extraction from Stereo Recordings," AES 123rd Convention, Convention Paper 7282, Oct. 5-8, 2007, pp. 1-5, New York, New York.

Faller, "Multiple-Loudspeaker Playback of Stereo Signals," J. Audio Eng. Soc., vol. 54, No. 11, Nov. 2006, pp. 1051-1064.

Goodwin et al., "Binaural 3-D Audio Rendering Based on Spatial Audio Scene Coding," AES 123rd Convention, Convention Paper 7277, Oct. 5-8, 2007, pp. 1-12, New York, New York.

Usher et al., "Enhancement of Spatial Sound Quality: A New Reverberation-Extraction Audio Upmixer," IEEE Transactions on Audio, Speech, and Language Processing, vol. 15, No. 7, Sep. 2007, pp. 2141-2150.

"Text of ISO/IEC FDIS 23003-1, MPEG Surround," ISO/IEC 2006, Jul. 2006, 293 pages.

Breebarrt et al., "Multi-Channel Goes Mobile: MPEG Surround Binaural Rendering," AES 29th International Conference, Sep. 2-4, 2006, pp. 1-13, Seoul, Korea.

English translation of Official Communication issued in corresponding Japanese Patent Application No. 2012-548400, mailed on Oct. 22, 2014.

* cited by examiner (APPARATUS FOR EXTRACTING A DIRECT/AMBIENCE SIGNAL)

(PARAMETRIC STEREO STREAM)

(SPECTRAL DECOMPOSITION OF MULTI-CHANNEL AUDIO SIGNAL $Ch_1 \ldots Ch_N$)

(INTER-CHANNEL RELATIONS)

(DIRECT/AMBIENCE EXTRACTION WITH DOWNMIXING OF ESTIMATED LEVEL INFORMATION)

(DIRECT/AMBIENCE EXTRACTION BY APPLYING GAIN PARAMETERS)

(DIRECT/AMBIENCE EXTRACTION BY LMS SOLUTION)

(DIRECT/AMBIENCE ESTIMATION USING STEREO AMBIENCE ESTIMATION FORMULA)

750

$R_1$: ICC=0 ('fully decoherent')
⇒ DTT=0 ('fully ambient')

$R_2$: ICC=1 ('fully coherent')
⇒ DTT=1 ('fully direct')

(DIRECT-TO-TOTAL ENERGY RATIO VERSUS INTER-CHANNEL COHERENCE)

(ENCODER/DECODER)

(OVERVIEW OF BINAURAL DIRECT SOUND RENDERING)

(DETAILS OF THE BINAURAL DIRECT SOUND RENDERING)

(OVERVIEW OF BINAURAL AMBIENT SOUND RENDERING)

(DETAILS OF BINAURAL AMBIENT SOUND RENDERING)

(CONCEPTUAL BLOCK DIAGRAM OF PROPOSED BINAURAL REPRODUCTION)

(OVERALL BLOCK DIAGRAM INCLUDING USE CASE OF BINAURAL REPRODUCTION)

(DIRECT/AMBIENCE EXTRACTION FROM A MONO DOWNMIX SIGNAL IN A FILTERBANK DOMAIN)

(DIRECT/AMBIENCE EXTRACTION BLOCKS)

(MPEG SURROUND DECODING SCHEME)

APPARATUS AND METHOD FOR EXTRACTING A DIRECT/AMBIENCE SIGNAL FROM A DOWNMIX SIGNAL AND SPATIAL PARAMETRIC INFORMATION

CROSS-REFERENCE TO RELATED APPLICATIONS

This application is a continuation of copending International Application No. PCT/EP2011/050265, filed Jan. 11, 2011, which is incorporated herein by reference in its entirety, and additionally claims priority from U.S. Application No. 61/295,278, filed Jan. 15, 2010 and European Application No. EP 10174230.2, filed Aug. 26, 2010, all of which are incorporated herein by reference in their entirety.

BACKGROUND OF THE INVENTION

The present invention relates to audio signal processing and, in particular, to an apparatus and a method for extracting a direct/ambience signal from a downmix signal and spatial parametric information. Further embodiments of the present invention relate to a utilization of direct-/ambience separation for enhancing binaural reproduction of audio signals. Yet further embodiments relate to binaural reproduction of multi-channel sound, where multi-channel audio means audio having two or more channels. Typical audio content having multi-channel sound is movie soundtracks and multi-channel music recordings.

The human spatial hearing system tends to process the sound roughly in two parts. These are on the one hand, a localizable or direct and, on the other hand, an unlocalizable or ambient part. There are many audio processing applications, such as binaural sound reproduction and multi-channel upmixing, where it is desirable to have access to these two audio components.

In the art, methods of direct/ambience separation as described in "Primary-ambient signal decomposition and vector-based localization for spatial audio coding and enhancement", Goodwin, Jot, IEEE Intl. Conf. On Acoustics, Speech and Signal proc, April 2007; "Correlation-based ambience extraction from stereo recordings", Merimaa, Goodwin, Jot, AES 123rd Convention, New York, 2007; "Multiple-loudspeaker playback of stereo signals", C. Faller, Journal of the AES, October 2007; "Primary-ambient decomposition of stereo audio signals using a complex similarity index"; Goodwin et al., Pub. No: US2009/0198356 A1, August 2009; "Patent application title: Method to Generate Multi-Channel Audio Signal from Stereo Signals", Inventors: Christof Faller, Agents: FISH & RICHARDSON P. C., Assignees: LG ELECTRONICS, INC., Origin: MINNEAPOLIS, Minn. US, IPC8 Class: AH04R500FI, USPC Class: 381 1; and "Ambience generation for stereo signals", Avendano et al., Date Issued: Jul. 28, 2009, Application: Ser. No. 10/163,158, Filed: Jun. 4, 2002 are known, which may be used for various applications. The state-of-art direct-ambience separation algorithms are based on inter-channel signal comparison of stereo sound in frequency bands.

Moreover, in "Binaural 3-D Audio Rendering Based on Spatial Audio Scene Coding", Goodwin, Jot, AES 123rd Convention, New York 2007, binaural playback with ambience extraction is addressed. Ambience extraction in connection to binaural reproduction is also mentioned in J. Usher and J. Benesty, "Enhancement of spatial sound quality: a new reverberation-extraction audio upmixer," IEEE Trans. Audio, Speech, Language Processing, vol. 15, pp. 2141-2150, September 2007. The latter paper focuses on ambience extraction in stereo microphone recordings, using adaptive least-mean-square cross-channel filtering of the direct component in each channel. Spatial audio codecs, e.g. MPEG surround, typically consist of a one or two channel audio stream in combination with spatial side information, which extends the audio into multiple channels, as described in ISO/IEC 23003-1—MPEG Surround; and Breebaart, J., Herre, J., Villemoes, L., Jin, C., Kjörling, K., Plogsties, J., Koppens, J. (2006). "Multi-channel goes mobile: MPEG Surround binaural rendering". Proc. 29th AES conference, Seoul, Korea.

However, modern parametric audio coding technologies, such as MPEG-surround (MPS) and parametric stereo (PS) only provide a reduced number of audio downmix channels—in some cases only one—along with additional spatial side information. The comparison between the "original" input channels is then only possible after first decoding the sound into the intended output format.

Therefore, a concept for extracting a direct signal portion or an ambient signal portion from a downmix signal and spatial parametric information is needed. However, there are no existing solutions to the direct/ambience extraction using the parametric side information.

SUMMARY

According to an embodiment, an apparatus for extracting a direct and/or ambience signal from a downmix signal and spatial parametric information, the downmix signal and the spatial parametric information representing a multi-channel audio signal having more channels than the downmix signal, wherein the spatial parametric information has inter-channel relations of the multi-channel audio signal, may have a direct/ambience estimator for estimating a direct level information of a direct portion of the multi-channel audio signal and/or for estimating an ambience level information of an ambient portion of the multi-channel audio signal based on the spatial parametric information; and a direct/ambience extractor for extracting a direct signal portion and/or an ambient signal portion from the downmix signal based on the estimated direct level information of the direct portion or based on the estimated ambience level information of the ambient portion.

According to another embodiment, a method for extracting a direct and/or ambience signal from a downmix signal and spatial parametric information, the downmix signal and the spatial parametric information representing a multi-channel audio signal having more channels than the downmix signal, wherein the spatial parametric information has inter-channel relations of the multi-channel audio signal, may have the steps of estimating a direct level information of a direct portion of the multi-channel audio signal and/or estimating an ambience level information of an ambient portion of the multi-channel audio signal based on the spatial parametric information; and extracting a direct signal portion and/or an ambient signal portion from the downmix signal based on the estimated direct level information of the direct portion or based on the estimated ambience level information of the ambient portion.

According to another embodiment, a computer program may have a program code for performing, when the computer program is executed on a computer, the method of extracting a direct and/or ambience signal from a downmix signal and spatial parametric information, the downmix signal and the spatial parametric information representing a multi-channel audio signal comprising more channels than the downmix signal, wherein the spatial parametric information comprises inter-channel relations of the multi-channel audio signal, the method having the steps of estimating a direct level information of a direct portion of the multi-channel audio signal and/or estimating an ambience level information of an ambient portion of the multi-channel audio signal based on the spatial parametric information; and extracting a direct signal portion and/or an ambient signal portion from the downmix signal based on the estimated direct level information of the direct portion or based on the estimated ambience level information of the ambient portion.

The basic idea underlying the present invention is that the above-mentioned direct/ambience extraction can be achieved when a level information of a direct portion or an ambient portion of a multi-channel audio signal is estimated based on the spatial parametric information and a direct signal portion or an ambient signal portion is extracted from a downmix signal based on the estimated level information. Here, the downmix signal and the spatial parametric information represent the multi-channel audio signal having more channels than the downmix signal. This measure enables a direct and/or ambience extraction from a downmix signal having one or more input channels by using spatial parametric side information.

According to an embodiment of the present invention, an apparatus for extracting a direct/ambience signal from a downmix signal and spatial parametric information comprises a direct/ambience estimator and a direct/ambience extractor. The downmix signal and the spatial parametric information represent a multi-channel audio signal having more channels than the downmix signal. Moreover, the spatial parametric information comprises inter-channel relations of the multi-channel audio signal. The direct/ambience estimator is configured for estimating a level information of a direct portion or an ambient portion of the multi-channel audio signal based on the spatial parametric information. The direct/ambience extractor is configured for extracting a direct signal portion or an ambient signal portion from the downmix signal based on the estimated level information of the direct portion or the ambient portion.

According to another embodiment of the present invention, the apparatus for extracting a direct/ambience signal from a downmix signal and spatial parametric information further comprises a binaural direct sound rendering device, a binaural ambient sound rendering device and a combiner. The binaural direct sound rendering device is configured for processing the direct signal portion to obtain a first binaural output signal. The binaural ambient sound rendering device is configured for processing the ambient signal portion to obtain a second binaural output signal. The combiner is configured for combining the first and the second binaural output signals to obtain a combined binaural output signal. Therefore, a binaural reproduction of an audio signal, wherein the direct signal portion and the ambience signal portion of the audio signal are processed separately, may be provided.

BRIEF DESCRIPTION OF THE DRAWINGS

In the following, embodiments of the present invention are explained with reference to the accompanying drawings in which.

DETAILED DESCRIPTION OF THE INVENTION

Figure 1:
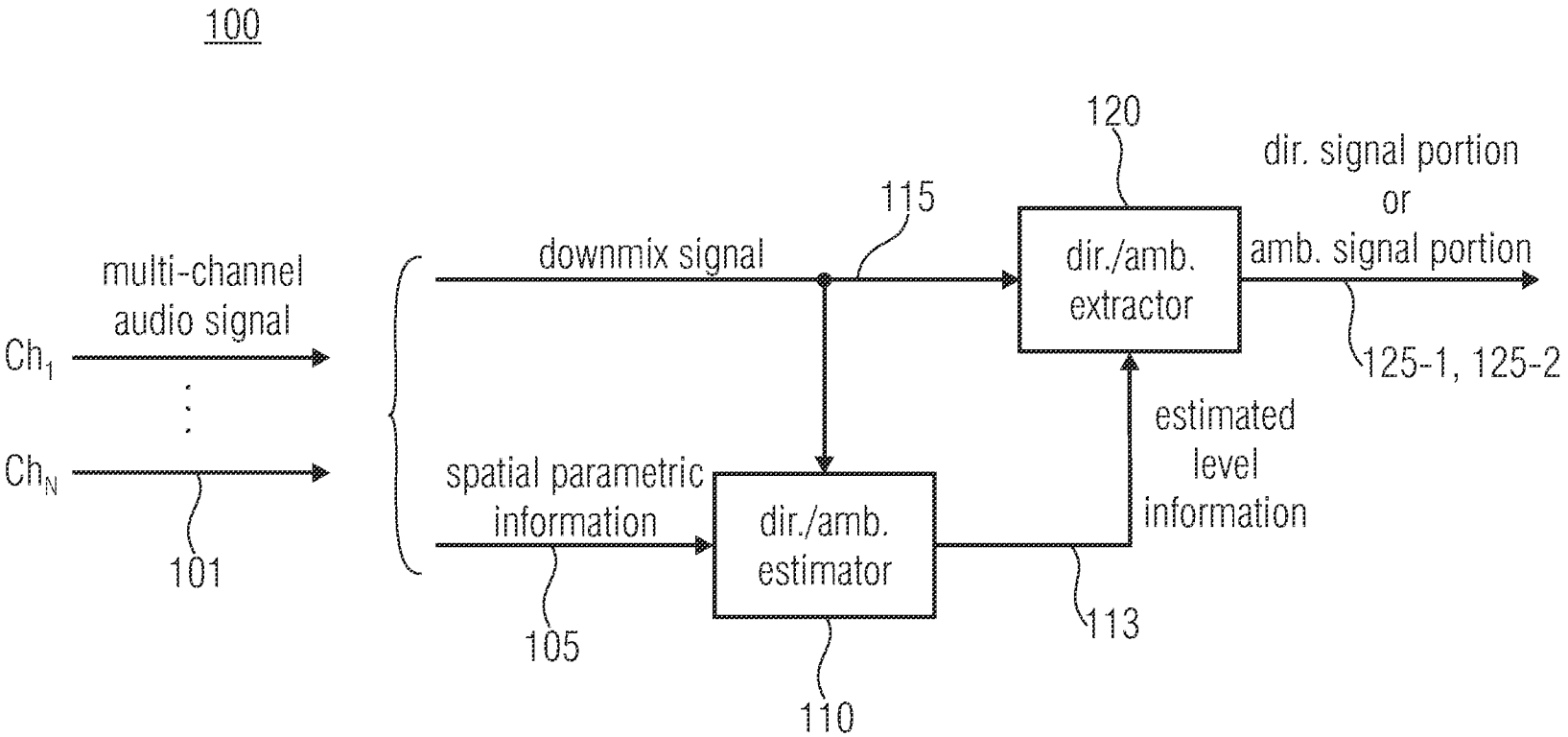
FIG. 1 is a block diagram of an embodiment of an apparatus for extracting a direct/ambience signal from a downmix signal and spatial parametric information representing a multi-channel audio signal.

FIG. 1 shows a block diagram of an embodiment of an apparatus 100 for extracting a direct/ambience signal 125-1, 125-2 from a downmix signal 115 and spatial parametric information 105. As shown in FIG. 1, the downmix signal 115 and the spatial parametric information 105 represent a multi-channel audio signal 101 having more channels $Ch_1 \ldots Ch_N$ than the downmix signal 115. The spatial parametric information 105 may comprise inter-channel relations of the multi-channel audio signal 101. In particular, the apparatus 100 comprises a direct/ambience estimator 110 and a direct/ambience extractor 120. The direct/ambience estimator 110 may be configured for estimating level information 113 of a direct portion or an ambient portion of the multi-channel audio signal 101 based on the spatial parametric information 105. The direct/ambience extractor 120 may be configured for extracting a direct signal portion 125-1 or an ambient signal portion 125-2 from the downmix signal 115 based on the estimated level information 113 of the direct portion or the ambient portion.

Figure 2:
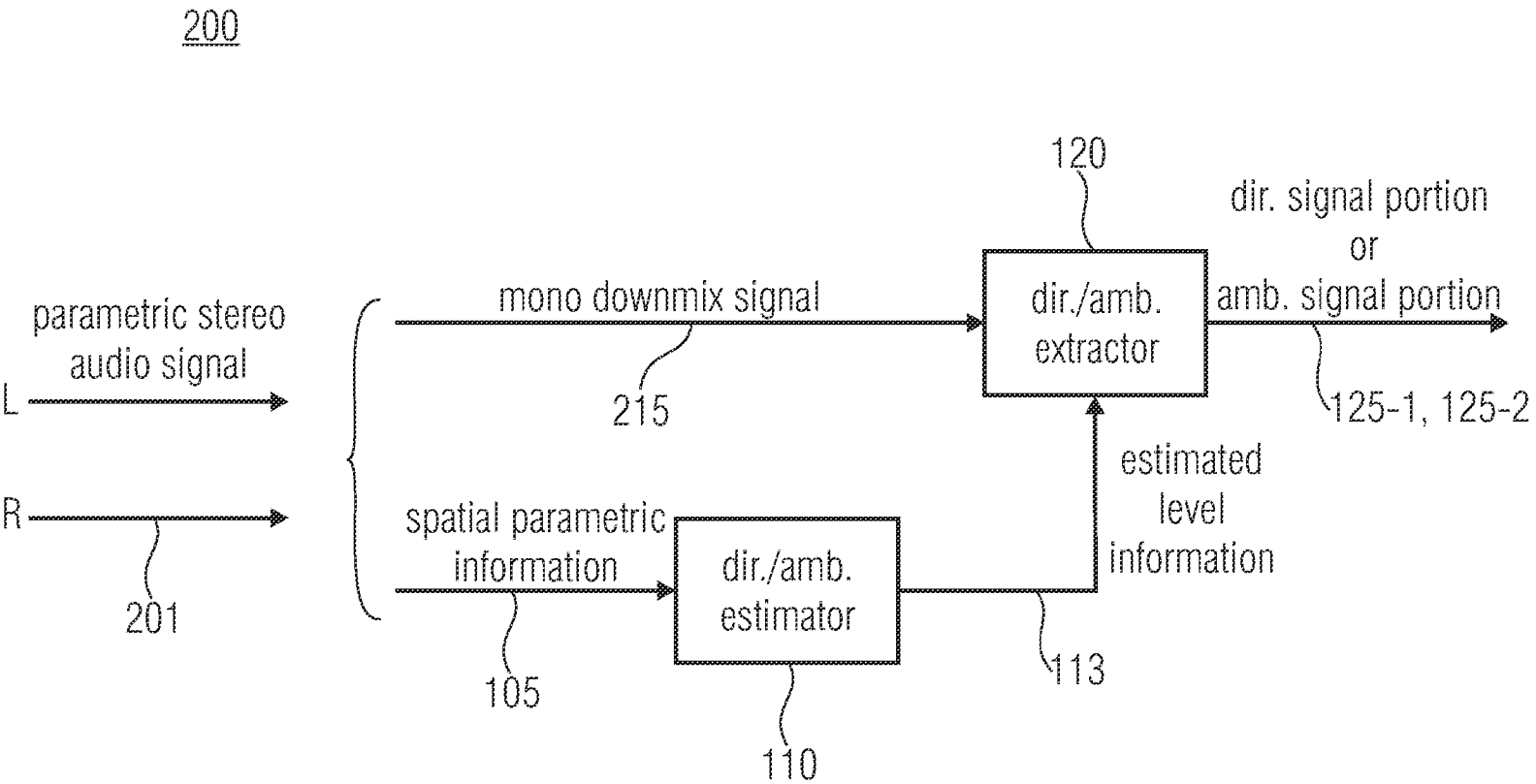
FIG. 2 is a block diagram of an embodiment of an apparatus for extracting a direct/ambience signal from a mono downmix signal and spatial parametric information representing a parametric stereo audio signal.

FIG. 2 shows a block diagram of an embodiment of an apparatus 200 for extracting a direct/ambience signal 125-1, 125-2 from a mono downmix signal 215 and spatial parametric information 105 representing a parametric stereo audio signal 201. The apparatus 200 of FIG. 2 essentially comprises the same blocks as the apparatus 100 of FIG. 1. Therefore, identical blocks having similar implementations and/or functions are denoted by the same numerals. Moreover, the parametric stereo audio signal 201 of FIG. 2 may correspond to the multi-channel audio signal 101 of FIG. 1, and the mono downmix signal 215 of FIG. 2 may correspond to the downmix signal 115 of FIG. 1. In the embodiment of FIG. 2, the mono downmix signal 215 and the spatial parametric information 105 represent the parametric stereo audio signal 201. The parametric stereo audio signal may comprise a left channel indicated by 'L' and a right channel indicated by 'R'. Here, the direct/ambience extractor 120 is configured to extract the direct signal portion 125-1 or the ambient signal portion 125-2 from the mono downmix signal 215 based on the estimated level information 113, which can be derived from the spatial parametric information 105 by the use of the direct/ambience estimator 110.

In practice, the spatial parameters (spatial parametric information 105) in the FIG. 1 or FIG. 2 embodiment, respectively, refer especially to the MPEG surround (MPS) or parametric stereo (PS) side information. These two technologies are state-of-art low-bitrate stereo or surround audio coding methods. Referring to FIG. 2, PS provides one downmix audio channel with spatial parameters, and referring to FIG. 1, MPS provides one, two or more downmix audio channels with spatial parameters.

Specifically, the embodiments of FIG. 1 and FIG. 2 show clearly that the spatial parametric side information 105 can readily be used in field of direct and/or ambience extraction from a signal (i.e. downmix signal 115; 215) that has one or more input channels.

Figure 3A:
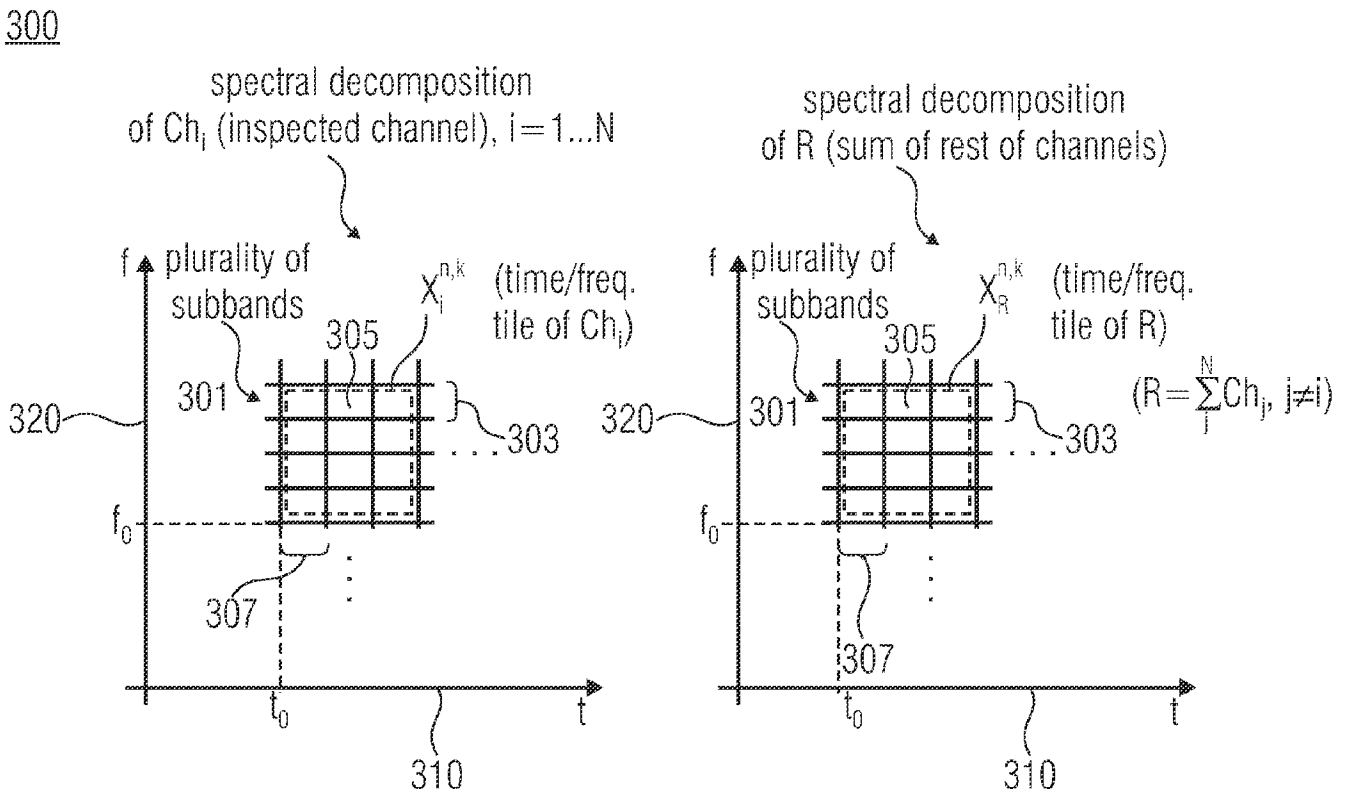
FIG. 3*a* is a schematic illustration of the spectral decomposition of a multi-channel audio signal according to an embodiment of the present invention.
Figure 3B:
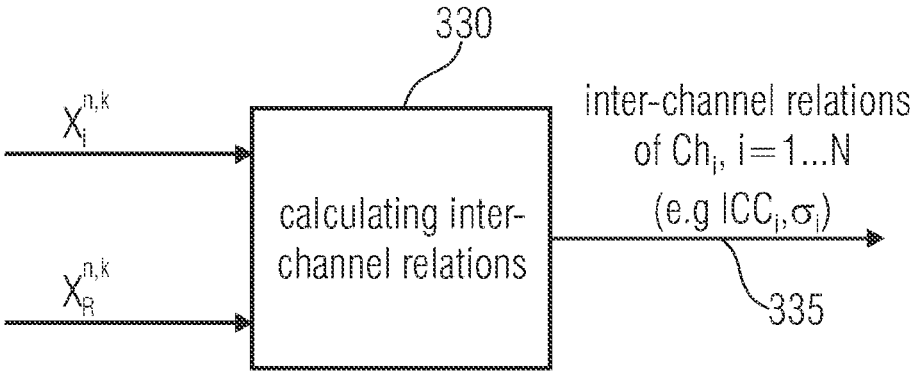
FIG. 3*b* is a schematic illustration for calculating inter-channel relations of a multi-channel audio signal based on the spectral decomposition of FIG. 3*a;*

The estimation of direct and/or ambience levels (level information 113) is based on information about the inter-channel relations or inter-channels differences, such as level differences and/or correlation. These values can be calculated from a stereo or multi-channel signal. FIG. 3*a* shows a schematic illustration of spectral decomposition 300 of a multi-channel audio signal ($Ch_1 \ldots Ch_N$) to be used for calculating inter-channel relations of respective $Ch_1 \ldots Ch_N$. As can be seen in FIG. 3*a*, a spectral decomposition of an inspected channel $Ch_i$ of the multi-channel audio signal ($Ch_1 \ldots Ch_N$) or a linear combination R of the rest of the channels, respectively, comprises a plurality 301 of subbands, wherein each subband 303 of the plurality 301 of subbands extends along a horizontal axis (time axis 310) having subband values 305, as indicated by small boxes of a time/frequency grid. Moreover, the subbands 303 are located consecutively along a vertical axis (frequency axis 320) corresponding to different frequency regions of a filter bank. In FIG. 3*a*, a respective time/frequency tile $X_i^{n,k}$ or $X_R^{n,k}$ is indicated by a dashed line. Here, the index i denotes channel $Ch_i$ and R the linear combination of the rest of the channels, while the indices n and k correspond to certain filter bank time slots 307 and filter bank subbands 303. Based on these time/frequency tiles $X_i^{n,k}$ and $X_R^{n,k}$ e.g. being located at the same time/frequency point ($t_0$, $f_0$) with respect to time/frequency axes 310, 320, inter-channel relations 335, such as inter-channel coherences ($ICC_i$) or channel level differences ($CLD_i$) of the inspected channel $Ch_i$, may be calculated in a step 330, as shown in FIG. 3*b*. Here, the calculation of the inter-channel relations $ICC_i$ and $CLD_i$ may be performed by using the following relations:

$$ICC_i = \frac{\langle Ch_i R^* \rangle}{\sqrt{\langle Ch_i Ch_i^* \rangle \langle RR^* \rangle}}$$

$$\sigma_i = \frac{\langle Ch_i Ch_i^* \rangle}{\langle RR^* \rangle}$$

wherein $Ch_i$ is the inspected channel and R the linear combination of remaining channels, while < . . . > denotes a time average. An example of a linear combination R of remaining channels is their energy-normalized sum. Furthermore, the channel level difference ($CLD_i$) is typically a decibel value of the parameter $\sigma_i$.

With reference to the above equations, the channel level difference ($CLD_i$) or parameter $\sigma_i$ may correspond to a level $P_i$ of channel $Ch_i$ normalized to a level $P_R$ of the linear combination R of the rest of the channels. Here, the levels $P_i$ or $P_R$ can be derived from the inter-channel level difference parameter $ICLD_i$ of channel $Ch_i$ and a linear combination $ICLD_R$ of inter-channel level difference parameters $ICLD_j$ ($j \neq i$) of the rest of the channels.

Here, $ICLD_i$ and $ICLD_j$ may be related to a reference channel $Ch_{ref}$, respectively. In further embodiments, the inter-channel level difference parameters $ICLD_i$ and $ICLD_j$ may also be related to any other channel of the multi-channel audio signal ($Ch_1 \ldots Ch_N$) being the reference channel $Ch_{ref}$. This, eventually, will lead to the same result for the channel level difference ($CLD_i$) or parameter $\sigma_i$.

According to further embodiments, the inter-channel relations 335 of FIG. 3*b* may also be derived by operating on different or all pairs $Ch_i$, $Ch_j$ of input channels of the multi-channel audio signal ($Ch_1 \ldots Ch_N$). In this case, pairwise calculated inter-channel coherence parameters $ICC_{i,j}$ or channel level difference ($CLD_{i,j}$) or parameters $\sigma_{i,j}$ (or $ICLD_{i,j}$) may be obtained, the indices (i, j) denoting a certain pair of channels $Ch_i$ and $Ch_j$, respectively.

Figure 4:
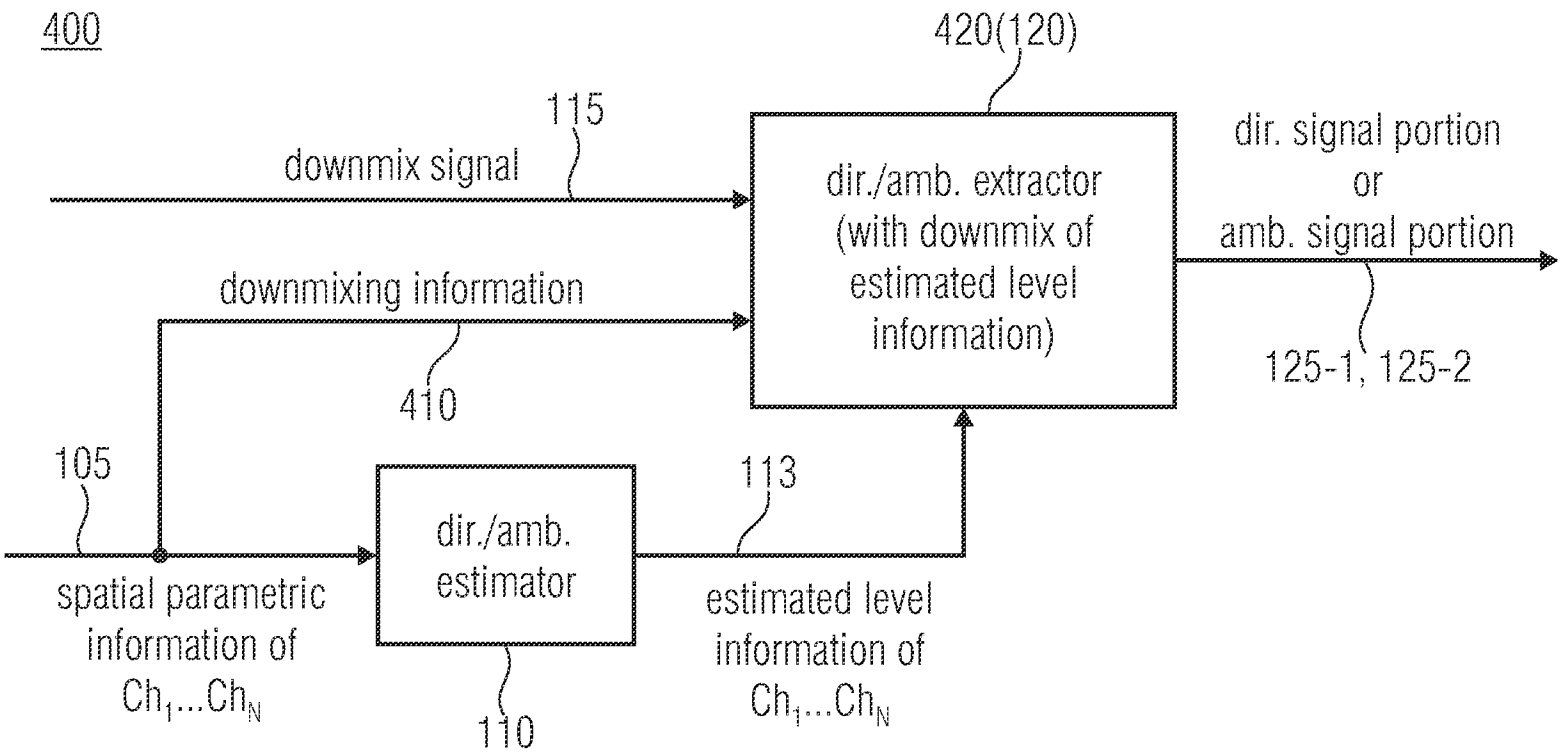
FIG. 4 is a block diagram of an embodiment of a direct/ambience extractor with downmixing of estimated level information.

FIG. 4 shows a block diagram of an embodiment 400 of a direct/ambience extractor 420, which includes downmixing of the estimated level information 113. The FIG. 4 embodiment essentially comprises the same blocks as the FIG. 1 embodiment. Therefore, identical blocks having similar implementations and or functions are denoted by the same numerals. However, the direct/ambience extractor 420 of FIG. 4, which may correspond to the direct/ambience extractor 120 of FIG. 1, is configured to downmix the estimated level information 113 of the direct portion or the ambient portion of the multi-channel audio signal to obtain downmixed level information of the direct portion or the ambient portion and extract the direct signal portion 125-1 or the ambient signal portion 125-2 from the downmix signal 115 based on the downmixed level information. As shown in FIG. 4, the spatial parametric information 105 can, for example, be derived from the multi-channel audio signal 101 ($Ch_1 \ldots Ch_N$) of FIG. 1 and may comprise the inter-channel relations 335 of $Ch_1 \ldots Ch_N$ introduced in FIG. 3*b*. The spatial parametric information 105 of FIG. 4 may also comprise downmixing information 410 to be fed into the direct/ambience extractor 420. In embodiments, the downmixing information 410 may characterize a downmix of an original multi-channel audio signal (e.g. the multi-channel audio signal 101 of FIG. 1) into the downmix signal 115. The downmixing may, for example, be performed by using a downmixer (not shown) operating in any coding domain, such as in a time domain or a spectral domain.

According to further embodiments, the direct/ambience extractor 420 may also be configured to perform a downmix of the estimated level information 113 of the direct portion or the ambient portion of the multi-channel audio signal 101 by combining the estimated level information of the direct portion with coherent summation and the estimated level information of the ambient portion with incoherent summation.

It is pointed out that the estimated level information may represent energy levels or power levels of the direct portion or the ambient portion, respectively.

In particular, the downmixing of the energies (i.e. level information 113) of the estimated direct/ambient part may be performed by assuming full incoherence or full coherence between the channels. The two formulas that may be applied in case of downmixing based on incoherent or coherent summation, respectively, are as follows.

For incoherent signals, the downmixed energy or downmixed level information can be calculated by $$E_{DMX} = \sum_{i=1}^{N} g_i^2 E_{Ch_i}.$$

For coherent signals, the downmixed energy or downmixed level information can be calculated by $$E_{DMX} = \left(\sum_{i=1}^{N} g_i \sqrt{E_{Ch_i}}\right)^2.$$

Here, g is the downmix gain, which may be obtained from the downmixing information, while $E(Ch_i)$ denotes the energy of the direct/ambient portion of a channel $Ch_i$ of the multi-channel audio signal. As a typical example of incoherent downmixing, in case of downmixing 5.1 channels into two, the energy of the left downmix can be:

$$E_{L_DMX}=E_{Left}+E_{Left_surround}+0.5*E_{Center}$$

Figure 5:
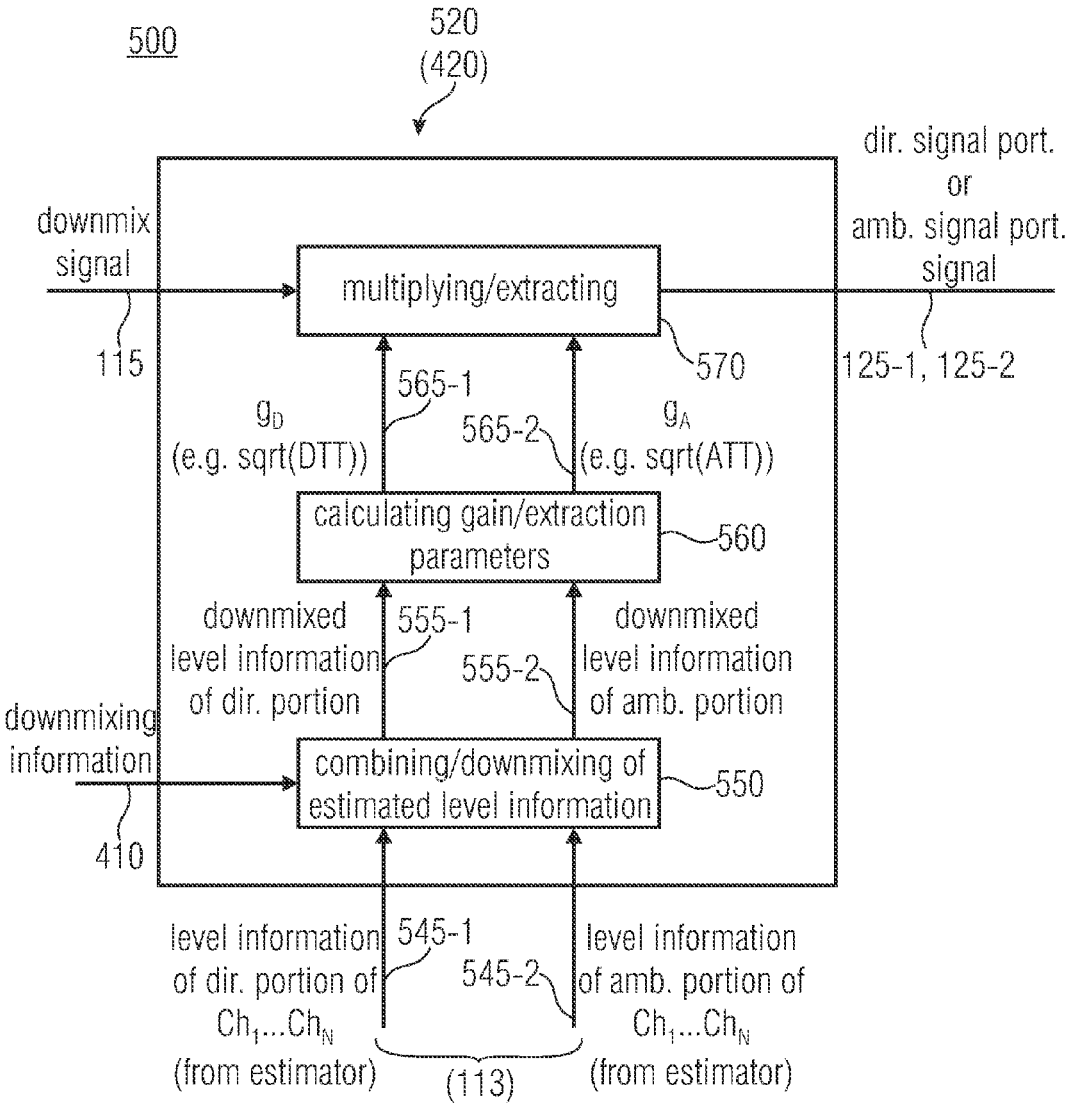
FIG. 5 is a block diagram of a further embodiment of a direct/ambience extractor by applying gain parameters to a downmix signal.

FIG. 5 shows a further embodiment of a direct/ambience extractor 520 by applying gain parameters $g_D$, $g_A$ to a downmix signal 115. The direct/ambience extractor 520 of FIG. 5 may correspond the direct/ambience extractor 420 of FIG. 4. First, estimated level information of a direct portion 545-1 or an ambient portion 545-2 may be received from a direct/ambience estimator as has been described before. The received level information 545-1, 545-2 may be combined/downmixed in a step 550 to obtain downmixed level information of the direct portion 555-1 or the ambient portion 555-2, respectively. Then, in a step 560, gain parameters $g_D$ 565-1 or $g_A$ 565-2 may be derived from the downmixed level information 555-1, 555-2 for the direct portion or the ambient portion, respectively. Finally, the direct/ambience extractor 520 may be used for applying the derived gain parameters 565-1, 565-2 to the downmix signal 115 (step 570), such that the direct signal portion 125-1 or the ambient signal 125-2 will be obtained.

Here, it is to be noted that in the embodiments of FIGS. 1; 4; 5, the downmix signal 115 may consist of a plurality of downmix channels ($Ch_1 \ldots Ch_M$) present at the inputs of the direct/ambience extractors 120; 420; 520, respectively.

In further embodiments, the direct/ambience extractor 520 is configured to determine a direct-to-total (DTT) or an ambient-to-total (ATT) energy ratio from the downmixed level information 555-1, 555-2 of the direct portion or the ambient portion and use as the gain parameters 565-1, 565-2 extraction parameters based on the determined DTT or ATT energy ratio.

In yet further embodiments, the direct/ambience extractor 520 is configured to multiply the downmix signal 115 with a first extraction parameter sqrt (DTT) to obtain the direct signal portion 125-1 and with a second extraction parameter sqrt (ATT) to obtain the ambient signal portion 125-2. Here, the downmix signal 115 may corresponds to the mono downmix signal 215 as shown in the FIG. 2 embodiment ('mono downmix case').

In the mono downmix case, the ambience extraction can be done by applying sqrt(ATT) and sqrt(DTT). However, the same approach is valid also for multichannel downmix signals, in particular, by applying sqrt($ATT_i$) and sqrt($DTT_i$) for each channel $Ch_i$.

According to further embodiments, in case the downmix signal 115 comprises a plurality of channels ('multichannel downmix case'), the direct/ambience extractor 520 may be configured to apply a first plurality of extraction parameters, e.g. sqrt($DTT_i$), to the downmix signal 115 to obtain the direct signal portion 125-1 and a second plurality of extraction parameters, e.g. sqrt($ATT_i$), to the downmix signal 115 to obtain the ambient signal portion 125-2. Here, the first and the second plurality of extraction parameters may constitute a diagonal matrix.

In general, the direct/ambience extractor 120; 420; 520 can also be configured to extract the direct signal portion 125-1 or the ambient signal portion 125-2 by applying a quadratic M-by-M extraction matrix to the downmix signal 115, wherein a size (M) of the quadratic M-by-M extraction matrix corresponds to a number (M) of downmix channels ($Ch_1 \ldots Ch_M$).

The application of ambience extraction can therefore be described by applying a quadratic M-by-M extraction matrix, where M is the number of downmix channels ($Ch_1 \ldots Ch_M$). This may include all possible ways to manipulate the input signal to get the direct/ambience output, including the relatively simple approach based on the sqrt($ATT_i$) and sqrt ($DTT_i$) parameters representing main elements of a quadratic M-by-M extraction matrix being configured as a diagonal matrix, or an LMS crossmixing approach as a full matrix. The latter will be described in the following. Here, it is to be noted that the above approach of applying the M-by-M extraction matrix covers any number of channels, including one.

According to further embodiments, the extraction matrix may not necessarily be a quadratic matrix of matrix size M-by-M, because we could have a lesser number of output channels. Therefore, the extraction matrix may have a reduced number of lines. An example of this would be extracting a single direct signal instead of M.

It is also not necessary to take all M downmix channels as the input corresponding to having M columns of the extraction matrix. This, in particular, could be relevant to applications where it is not required to have all channels as inputs.

Figure 6:
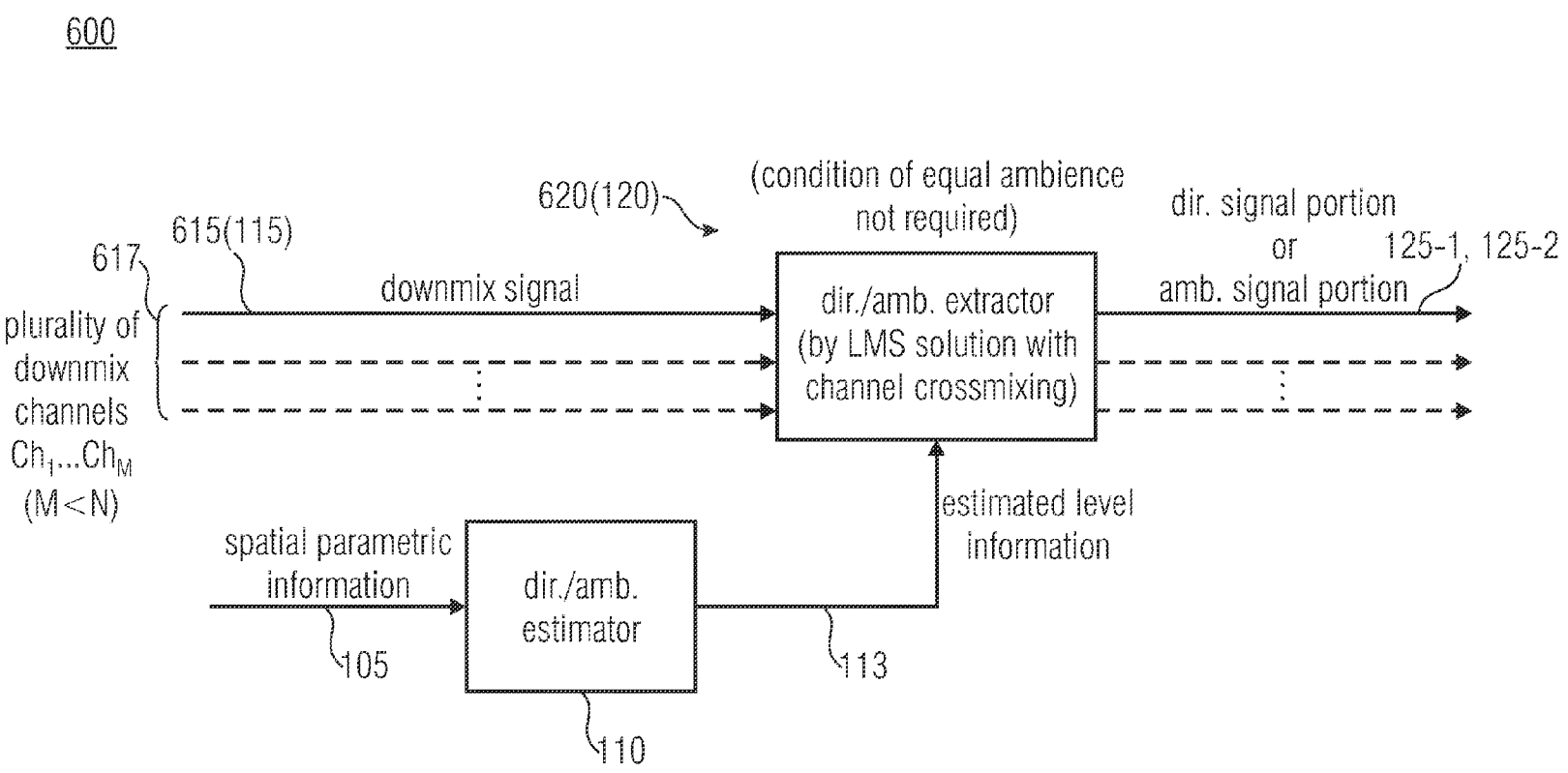
FIG. 6 is a block diagram of a further embodiment of a direct/ambience extractor based on LMS solution with channel crossmixing.

FIG. 6 shows the block diagram of a further embodiment 600 of a direct/ambience extractor 620 based on LMS (least-mean-square) solution with channel crossmixing. The direct/ambience extractor 620 of FIG. 6 may correspond to the direct/ambience extractor 120 of FIG. 1. In the embodiment of FIG. 6, identical blocks having similar implementations and/or functions as in the embodiment of FIG. 1 are therefore denoted by the same numerals. However, the downmix signal 615 of FIG. 6, which may correspond to the downmix signal 115 of FIG. 1, may comprise a plurality 617 of downmix channels $Ch_1 \ldots Ch_M$, wherein the number of the downmix channels (M) is smaller than that of the channels $Ch_1 \ldots Ch_N$ (N) of the multi-channel audio signal 101, i.e. M<N. Specifically, the direct/ambience extractor 620 is configured to extract the direct signal portion 125-1 or the ambient signal portion 125-2 by a least-mean-square (LMS) solution with channel crossmixing, the LMS solution not requiring equal ambience levels. Such an LMS solution that does not require equal ambience levels and is also extendable to any number of channels is provided in the following. The just-mentioned LMS solution is not mandatory, but represents a more precise alternative to the above.

The used symbols in the LMS solution for the crossmixing weights for direct/ambience extraction are:

$Ch_i$ channel i $a_i$ gain of the direct sound in channel i

D and $\hat{D}$ direct part of the sound and its estimate $A_i$ and $\hat{A}_i$ ambient part of channel i and its estimate $P_X$=E[XX*] estimated energy of X E[ ] expectation $E_{\hat{X}}$ estimation error of X $w_{\hat{D}i}$ LMS crossmixing weights for channel i to the direct part $w_{\hat{A}i,n}$ LMS crossmixing weights for channel n to ambience of channel i In this context, it is to be noted that the derivation of the LMS solution may be based on a spectral representation of respective channels of the multi-channel audio signal, which means that everything functions in frequency bands.

The signal model is given by $$Ch_i=a_iD+A_i$$

The derivation first deals with a) the direct part and then b) with the ambient part. Finally, the solution for the weights is derived and the method for a normalization of the weights is described.

a) Direct Part

The estimation of the weights direct part is $$\hat{D}=\sum_{i=1}^{N} w_{\hat{D}i}Ch_i=\sum_{i=1}^{N} w_{\hat{D}i}(a_iD+A_i).$$

The estimation error reads $$E_{\hat{D}}=D-\hat{D}=D-\sum_{i=1}^{N} w_{\hat{D}i}(a_iD+A_i).$$

To have the LMS solution, we need $E_D$ orthogonal to the input signals $$E[E_{\hat{D}}Ch_k]=0, \text{ for all } k$$

$$E\left[\left(D-\sum_{i=1}^{N} w_{\hat{D}i}(a_iD+A_i)\right)(a_kD+A_k)^*\right]=\left(a_k-\sum_{i=1}^{N} w_{\hat{D}i}a_ia_k\right)P_D-w_{\hat{D}k}P_{Ak}$$

$$=0 \Leftrightarrow \sum_{i=1}^{N} w_{\hat{D}i}a_ia_kP_D+w_{\hat{D}k}P_{AK}$$

$$=a_kP_D$$

In matrix form, the above relation reads $$A\overline{w}=P\begin{bmatrix}(a_1a_1P_D+P_{A1}) & a_1a_2P_D & \cdots & a_1a_NP_D\\ a_1a_2P_D & (a_2a_2P_D+P_{A2}) & & \vdots\\ \vdots & & \ddots & \\ a_1a_NP_D & \cdots & & (a_Na_NP_D+P_{AN})\end{bmatrix}\begin{bmatrix}w_{\hat{D}1}\\ w_{\hat{D}2}\\ \vdots\\ w_{\hat{D}N}\end{bmatrix}$$

$$=\begin{bmatrix}a_1\\ a_2\\ \vdots\\ a_N\end{bmatrix}P_D$$

b) Ambience Part

We start from the same signal model and estimate the weights from $$\hat{A}_i=\sum_{n=1}^{N} w_{\hat{A}i,n}Ch_i=\sum_{n=1}^{N} w_{\hat{A}i,n}(a_iD+A_i)$$

The estimation error is $$E_{\hat{A}i}=A_i-\hat{A}_i=A_i-\sum_{n=1}^{N} w_{\hat{A}i,n}(a_iD+A_i)$$

and the orthogonality $$E[E_{\hat{A}i}Ch_k]=0, \text{ for all } k$$

$$E\left[\left(A_i-\sum_{n=1}^{N} w_{\hat{A}i,n}(a_nD+A_n)\right)(a_kD+A_k)^*\right]=$$

$$\begin{cases}-\sum_{n=1}^{N} w_{\hat{A}i,n}a_na_kP_D-w_{\hat{A}i,k}P_{Ak}=0, & \text{if } i\,!=k\\ -\sum_{n=1}^{N} w_{\hat{A}i,n}a_na_kP_D-w_{\hat{A}i,k}P_{Ak}+P_{Ak}=0, & \text{if } i==k\end{cases}\Leftrightarrow$$

$$\begin{cases}\sum_{n=1}^{N} w_{\hat{A}i,n}a_na_kP_D+w_{\hat{A}i,k}P_{Ak}=0, & \text{if } i\,!=k\\ \sum_{n=1}^{N} w_{\hat{A}i,n}a_na_kP_D+w_{\hat{A}i,k}P_{Ak}=P_{Ak}, & \text{if } i==k\end{cases}.$$

In matrix form, the above relation reads $$AW=P\begin{bmatrix}(a_1a_1P_D+P_{A1}) & a_1a_2P_D & \cdots & a_1a_NP_D\\ a_1a_2P_D & (a_2a_2P_D+P_{A2}) & & \vdots\\ \vdots & & \ddots & \\ a_1a_NP_D & \cdots & & (a_Na_NP_D+P_{AN})\end{bmatrix}$$

$$\begin{bmatrix}w_{\hat{A}1,1} & w_{\hat{A}2,1} & \cdots & w_{\hat{A}N,1}\\ w_{\hat{A}1,2} & w_{\hat{A}2,2} & & \vdots\\ \vdots & & \ddots & \\ w_{\hat{A}1,N} & \cdots & & w_{\hat{A}N,N}\end{bmatrix}=\begin{bmatrix}P_{A1} & 0 & \cdots & 0\\ 0 & P_{A2} & & \vdots\\ \vdots & & \ddots & \\ 0 & \cdots & & P_{AN}\end{bmatrix}$$

Solution for the Weights

The weights can be solved by inverting matrix A, which is identical in both calculation of the direct part and the ambient part. In case of stereo signals the solution is:

$$w_{D1} = \frac{a_1 P_D P_{A2}}{a_2 a_2 P_D P_{A1} + a_1 a_1 P_D P_{A2} + P_{A1} P_{A2}} = \frac{a_1 P_D P_{A2}}{div}$$

$$w_{D2} = \frac{a_2 P_D P_{A1}}{div}$$

$$w_{\hat{A}1,1} = \frac{a_2 a_2 P_D P_{A1} + P_{A1} P_{A2}}{div}$$

$$w_{\hat{A}1,2} = \frac{a_1 a_2 P_D P_{A1}}{div}$$

$$w_{\hat{A}2,1} = \frac{a_1 a_2 P_D P_{A2}}{div}$$

$$w_{\hat{A}2,2} = \frac{a_1 a_1 P_D P_{A2} + P_{A1} P_{A2}}{div}$$

where div is divisor $a_2 a_2 P_D P_{A1} + a_1 a_1 P_D P_{A2} + P_{A1} P_{A2}$.

Normalization of the Weights

The weights are for LMS solution, but because the energy levels should be preserved, the weights are normalized. This also makes the division by term div unnecessary in the above formulas. The normalization happens by ensuring the energies of the output direct and ambient channels are $P_D$ and $P_{Ai}$, where i is the channel index.

This is straightforward assuming that we know the inter-channel coherences, mixing factors and the channel energies. For simplicity, we focus in the two channel case and specially to one weight pair $w_{\hat{A}1,1}$ and $w_{\hat{A}1,2}$ which were the gains to produce the first ambience channel from the first and second input channels. The steps are as follows:

Step 1: Calculate the output signal energy (wherein coherent part adds up amplitudewise, and incoherent part energywise)

$$P_{\hat{A}1}(w_{\hat{A}1,1}\sqrt{|\mathrm{ICC}|\cdot P_1} + \mathrm{sign}(\mathrm{ICC}) w_{\hat{A}1,2} \sqrt{|ICC|\cdot P_2})^2 + (1-|\mathrm{ICC}|) P_1 w_{\hat{A}1,1}^2 + (1-|\mathrm{ICC}|) P_2 w_{\hat{A}1,2}^2$$

Step 2: Calculate the normalization gain factor $$g = \sqrt{\frac{P_{A1}}{P_{\hat{A}1}}}$$

and apply the result to the crossmixing weight factors $w_{\hat{A}1,1}$ and $w_{\hat{A}1,2}$. In step 1, the absolute values and the sign-operators for the ICC are included to take into account also the case that the input channels are negatively coherent. The remaining weight factors are also normalized in the same fashion.

In particular, referring to the above, the direct/ambience extractor 620 may be configured to derive the LMS solution by assuming a stable multi-channel signal model, such that the LMS solution will not be restricted to a stereo channel downmix signal.

Figure 7A:
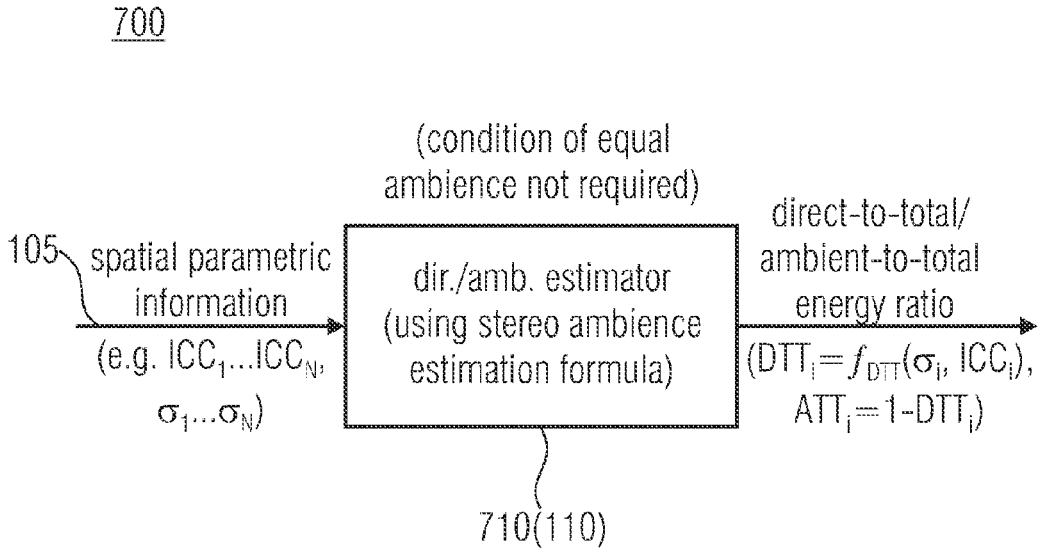
FIG. 7*a* is a block diagram of an embodiment of a direct/ambience estimator using a stereo ambience estimation formula.

FIG. 7*a* shows a block diagram of an embodiment 700 of a direct/ambience estimator 710, which is based on a stereo ambience estimation formula. The direct/ambience estimator 710 of FIG. 7 may correspond to the direct/ambience estimator 110 of FIG. 1. In particular, the direct/ambience estimator 710 of FIG. 7 is configured to apply a stereo ambience estimation formula using the spatial parametric information 105 for each channel ($Ch_i$) of the multi-channel audio signal 101, wherein the stereo ambience estimation formula may be represented as a functional dependence $$\mathrm{DTT}_i = f_{DTT}[\sigma_i(Ch_i,R), \mathrm{ICC}_i(Ch_i,R)],$$

$$\mathrm{ATT}_i = 1 - \mathrm{DTT}_i$$

explicitly showing a dependency on a channel level difference ($CLD_i$) or parameter $\sigma_i$ and an inter-channel coherence ($ICC_i$) parameter of the channel $Ch_i$. As depicted in FIG. 7, the spatial parametric information 105 is fed to the direct/ambience estimator 710 and may comprise the inter-channel relation parameters $ICC_i$ and $\sigma_i$ for each channel $Ch_i$. After applying this stereo ambience estimation formula by use of the direct/ambience estimator 710, the direct-to-total ($DTT_i$) or ambient-to-total ($ATT_i$) energy ratio, respectively, will be obtained at its output 715. It should be noted that the above stereo ambience estimation formula used for estimating the respective DTT or ATT energy ratio is not based on a condition of equal ambience.

In particular, the direct/ambience ratio estimation can be performed in that the ratio (DTT) of the direct energy in a channel in comparison to the total energy of that channel may be formulated by $$\mathrm{Ratio} = \frac{1}{2}\left[\left(1 - \frac{1}{\sigma}\right) + \sqrt{\left(\frac{1}{\sigma} - 1\right)^2 + 4\frac{ICC^2}{\sigma}}\right]$$

where $$\sigma = \frac{\langle ChCh^* \rangle}{\langle RR^* \rangle}$$

and $$ICC = \frac{\langle ChR^* \rangle}{\sqrt{\langle ChCh^* \rangle \langle RR^* \rangle}},$$

Ch is the inspected channel and R is the linear combination of the rest of the channels. $\langle\ \rangle$ is the time average. This formula follows when the ambience level is assumed equal in the channel and the linear combination of the rest of the channels, and the coherence of it to be zero.

Figure 7B:
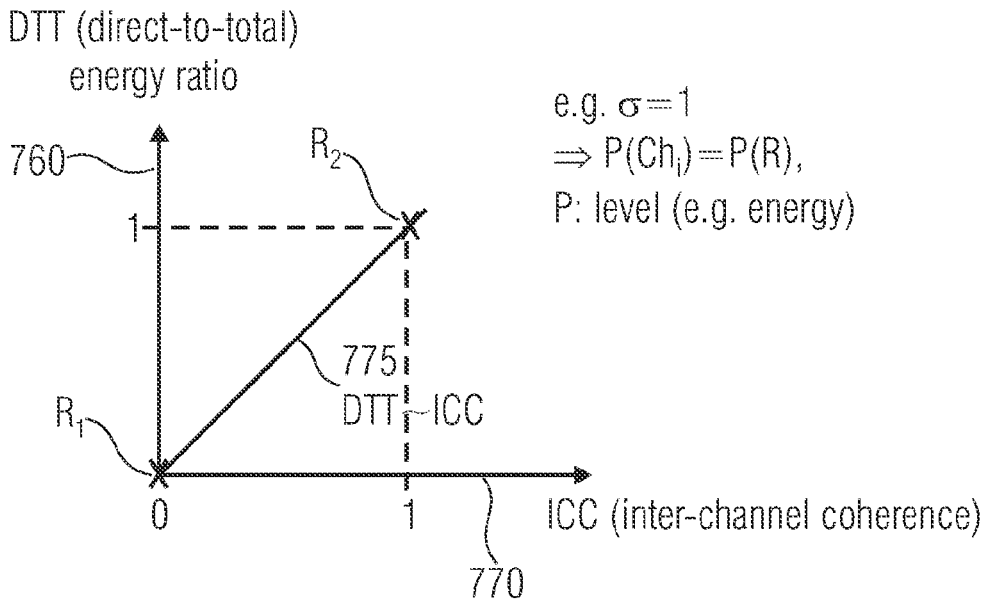
FIG. 7*b* is a graph of an exemplary direct-to-total energy ratio versus inter-channel coherence.

FIG. 7*b* shows a graph 750 of an exemplary DTT (direct-to-total) energy ratio 760 as a function of the inter-channel coherence parameter ICC 770. In the FIG. 7*b* embodiment, the channel level difference (CLD) or parameter $\sigma$ is exemplarily set to 1 ($\sigma$=1), such that the level $P(Ch_i)$ of the channel $Ch_i$ and the level P(R) of the linear combination R of the rest of the channels will be equal. In this case, the DTT energy ratio 760 will be linearly proportional to the ICC parameter as indicated by a straight line 775 marked by DTT~ICC. It can be seen in FIG. 7*b* that in case of ICC=0, which may correspond to fully decoherent inter-channel relation, the DTT energy ratio 760 will be 0, which may correspond to a fully ambient situation (case '$R_1$'). However, in case of ICC=1, which may correspond to a fully coherent inter-channel relation, the DTT energy ratio 760 may be 1, which may correspond to a fully direct situation (case '$R_2$'). Therefore, in the case $R_1$, there is essentially no direct energy, while in the case $R_2$, there is essentially no ambient energy in a channel with respect to the total energy of that channel.

Figure 8:
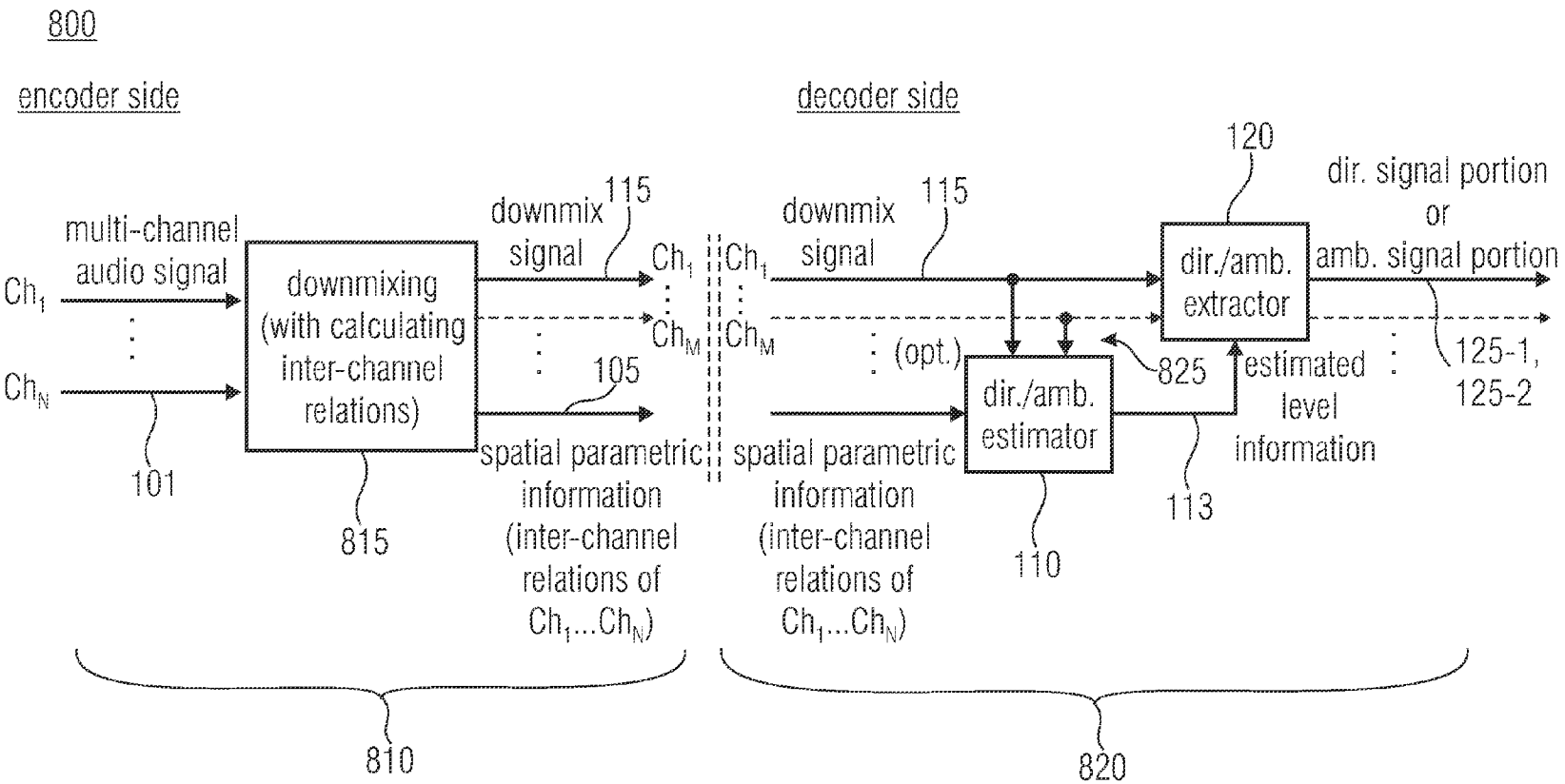
FIG. 8 is a block diagram of an encoder/decoder system according to an embodiment of the present invention.

FIG. 8 shows a block diagram of an encoder/decoder system 800 according to further embodiments of the present invention. On the decoder side of the encoder/decoder system 800, an embodiment of the decoder 820 is shown, which may correspond to the apparatus 100 of FIG. 1. Because of the similarity of the FIG. 1 and FIG. 8 embodiments, identical blocks having similar implementations and/or functions in these embodiments are denoted by the same numerals. As shown in the embodiments of FIG. 8, the direct/ambience extractor 120 may be operative on a downmix signal 115 having the plurality $Ch_1 \ldots Ch_M$ of downmix channels. The direct/ambience estimator 110 of FIG. 8 may furthermore be configured to receive at least two downmix channels 825 of the downmix signal 815 (optional), such that the level information 113 of the direct portion or the ambient portion of the multi-channel audio signal 101 will be estimated based beside the spatial parametric information 105 on the received at least two downmix channels 825. Finally, the direct signal portion 125-1 or the ambient signal portion 125-2 will be obtained after extraction by the direct/ambience extractor 120.

On the encoder side of the encoder/decoder system 800, an embodiment of an encoder 810 is shown, which may comprise a downmixer 815 for downmixing the multi-channel audio signal ($Ch_1 \ldots Ch_N$) into the downmix signal 115 having the plurality $Ch_1 \ldots Ch_M$ of downmix channels, wherein the number of channels is reduced from N to M. The downmixer 815 may also be configured to output the spatial parametric information 105 by calculating inter-channel relations from the multi-channel audio signal 101. In the encoder/decoder system 800 of FIG. 8, the downmix signal 115 and the spatial parametric information 105 may be transmitted from the encoder 810 to the decoder 820. Here, the encoder 810 may derive an encoded signal based on the downmix signal 115 and the spatial parametric information 105 for transmission from the encoder side to the decoder side. Moreover, the spatial parametric information 105 is based on channel information of the multi-channel audio signal 101.

On the one hand, the inter-channel relation parameters $\sigma_i(Ch_i, R)$ and $ICC_i(Ch_i, R)$ may be calculated between channel $Ch_i$ and the linear combination R of the rest of the channels in the encoder 810 and transmitted within the encoded signal. The decoder 820 may in turn receive the encoded signal and be operative on the transmitted inter-channel relation parameters $\sigma_i(Ch_i, R)$ and $ICC_i(Ch_i, R)$.

On the other hand, the encoder 810 may also be configured to calculate the inter-channel coherence parameters $ICC_{i,j}$ between pairs of different channels ($Ch_i$, $Ch_j$) to be transmitted. In this case, the decoder 810 should be able to derive the parameters $ICC_i(Ch_i, R)$ between channel $Ch_i$ and the linear combination R of the rest of the channels from the transmitted pairwise calculated $ICC_{i,j}(Ch_i, Ch_j)$ parameters, such that the corresponding embodiments having been described earlier may be realized. It is to be noted in this context that the decoder 820 cannot reconstruct the parameters $ICC_i(Ch_i, R)$ from the knowledge of the downmix signal 115 alone.

In embodiments, the transmitted spatial parameters are not only about pairwise channel comparisons.

For example, the most typical MPS case is that there are two downmix channels. The first set of spatial parameters in MPS decoding makes the two channels into three: Center, Left and Right. The set of parameters that guide this mapping are called center prediction coefficient (CPC) and an ICC parameter that is specific to this two-to-three configuration.

The second set of spatial parameters divides each into two: The side channels into corresponding front and rear channels, and the center channel into center and Lfe channel. This mapping is about ICC and CLD parameters introduced before.

It is not practical to make calculation rules for all kinds of downmixing configurations and all kinds of spatial parameters. It is however practical to follow the downmixing steps, virtually. As we know how the two channels are made into three, and the three are made into six, we in the end find an input-output-relation how the two input channels are routed to the six outputs. The outputs are only linear combinations of the downmix channels, plus linear combinations of the decorrelated versions of them. It is not necessary to actually decode the output signal and measure that, but as we know this "decoding matrix", we can computationally efficiently calculate the ICC and CLD parameters between any channels or combination of channels in parametric domain.

Regardless of the downmix- and the multichannel signal configuration, each output of the decoded signal is a linear combination of the downmix signals plus a linear combination of a decorrelated version of each of them.

$$\mathrm{Ch_out}_i = \sum_{k=1}^{dmx_channels} (a_{k,i}\mathrm{Ch_dmx}_k + b_{k,i}D[\mathrm{Ch_dmx}_k])$$

where operator D[ ] corresponds to a decorrelator, i.e. a process which makes an incoherent duplicate of the input signal. The factors a and b are known, since they are directly derivable from the parametric side information. This is because by definition, the parametric information is the guide for the decoder how to create the multichannel output from the downmix signals. The above formula can be simplified to $$\mathrm{Ch_out}_i = \sum_{k=1}^{dmx_channels} (a_{k,i}\mathrm{Ch_dmx}_k) + D_i$$

since all the decorrelated parts can be combined for the energetic/coherence comparison. The energy of D is known, since the factors b were also known in the first formula.

From this point, it is to be noted that we can do any kind of coherence and energy comparison between the output channels, or between different linear combinations of the output channels. In case of a simple example of two downmix channels, and a set of output channels, of which, for example, channels number 3 and 5 are compared against each other, the sigma is calculated as follows:

$$\sigma_{3,5} = \frac{E[\mathrm{Ch_out}_3^2]}{E[\mathrm{Ch_out}_5^2]}$$

where E[ ] is the expectation (in practice: average) operator. Both of the terms can be formulated as follows $$E[\mathrm{Ch_out}_i^2] = E\left[\left(\sum_{k=1}^{2} (a_{k,i}\mathrm{Ch_dmx}_k) + D_i\right)^2\right] =$$

$$E[D_i^2] + \sum_{k=1}^{2} (a_{k,i}^2 E[\mathrm{Ch_dmx}_k^2]) + 2a_{1,i}a_{2,i}(E[\mathrm{Ch_dmx}_1\mathrm{Ch_dmx}_2])$$

All parameters above are known or measurable from the downmix signals. Crossterms E[Ch_dmx*D] were by definition zero and therefore they are not in the lower row of the formula. Similarly, the coherence formula is $$ICC_{3,5} = \frac{E[\mathrm{Ch_out}_3\mathrm{Ch_out}_5]}{\sqrt{E[\mathrm{Ch_out}_3^2]E[\mathrm{Ch_out}_5^2]}}$$

Again, since all parts of the above formula are linear combination of the inputs plus decorrelated signal, the solution is straightforwardly available.

The above examples were with comparing two output channels, but similarly one can make a comparison between linear combinations of output channels, such as with an exemplary process that will be described later.

In summary of the previous embodiments, the presented technique/concept may comprise the following steps:

1. Retrieve the inter-channel relations (coherence, level) of an "original" set of channels that may be higher than the number of the downmix channel(s).
2. Estimate the ambience and direct energies in this "original" set of channels.
3. Downmix the direct and ambient energies of this "original" set of channels into a lower number of channels.
4. Use the downmixed energies to extract the direct and ambience signals in the provided downmix channels by applying gain factors or a gain matrix.

The usage of spatial parametric side information is best explained and summarized by the embodiment of FIG. 2. In the FIG. 2 embodiment, we have a parametric stereo stream, which includes a single audio channel and spatial side information about the inter-channel differences (coherence, level) of the stereo sound that it represents. Now since we know the inter-channel differences, we can apply the above stereo ambience estimation formula to them, and get the direct and ambient energies of the original stereo channels. Then we can "downmix" the channels energies by adding the direct energies together (with coherent summation) and ambience energies (with incoherent summation) and derive the direct-to-total and ambient-to-total energy ratios of the single downmix channel.

Referring to the FIG. 2 embodiment, the spatial parametric information essentially comprises inter-channel coherence ($ICC_L$, $ICC_R$) and channel level difference parameters ($CLD_L$, $CLD_R$) corresponding to the left (L) and the right channel (R) of the parametric stereo audio signal, respectively. Here, it is to be noted that the inter-channel coherence parameters $ICC_L$ and $ICC_R$ are equal ($ICC_L=ICC_R$), while the channel level difference parameters $CLD_L$ and $CLD_R$ are related by $CLD_L=-CLD_R$. Correspondingly, since the channel level difference parameters $CLD_L$ and $CLD_R$ are typically decibel values of the parameters $\sigma_L$ and $\sigma_R$, respectively, the parameters $\sigma_L$ and $\sigma_R$ for the left (L) and the right channel (R) are related by $\sigma_L=1/\sigma_R$. These inter-channel difference parameters can readily be used to calculate the respective direct-to-total ($DTT_L$, $DTT_R$) and ambient-to-total energy ratios ($ATT_L$, $ATT_R$) for both channels (L,R) based on the stereo ambience estimation formula. In the stereo ambience estimation formula, the direct-to-total and ambient-to-total energy ratios ($DTT_L$, $ATT_L$) of the left channel (L) depend on the inter-channel difference parameters ($CLD_L$, $ICC_L$) for the left channel L, while the direct-to-total and ambient-to-total energy ratios ($DTT_R$, $ATT_R$) of the right channel (R) depend on the inter-channel difference parameters ($CLD_R$, $ICC_R$) for the right channel R. Moreover, the energies ($E_L$, $E_R$) for both channels L, R of the parametric stereo audio signal can be derived based on the channel level difference parameters ($CLD_L$, $CLD_R$) for the left (L) and the right channel (R), respectively. Here, the energy ($E_L$) for the left channel L may be obtained by applying the channel level difference parameter ($CLD_L$) for the left channel L to the mono downmix signal, while the energy ($E_R$) for the right channel R may be obtained by applying the channel level difference parameter ($CLD_R$) for the right channel R to the mono downmix signal. Then, by multiplying the energies ($E_L$, $E_R$) for both channels (L, R) with corresponding $DTT_L$-, $DTT_R$- and $ATT_L$-, $ATT_R$-based parameters, the direct ($E_{DL}$, $E_{DR}$) and ambience energies ($E_{AL}$, $E_{AR}$) for both channels (L, R) will be obtained. Then, the direct energies ($E_{DL}$, $E_{DR}$) for both channels (L, R) may be combined/added by using a coherent downmixing rule to obtain a downmixed energy ($E_{D,mono}$) for the direct portion of the mono downmix signal, while the ambience energies ($E_{AL}$, $E_{AR}$) for both channels (L, R) may be combined/added by using an incoherent downmixing rule to obtain a downmixed energy ($E_{A,mono}$) for the ambient portion of the mono downmix signal. Then, by relating the downmixed energies ($E_{D,mono}$, $E_{A,mono}$) for the direct signal portion, of and the ambient signal portion to the total energy ($E_{mono}$) of the mono downmix signal, the direct-to-total ($DTT_{mono}$) and ambient-to-total energy ratio ($ATT_{mono}$) of the mono downmix signal will be obtained. Finally, based on these $DTT_{mono}$ and $ATT_{mono}$ energy ratios, the direct signal portion or the ambient signal portion can essentially be extracted from the mono downmix signal.

In reproduction of audio, there often arises a need to reproduce the sound over headphones. Headphone listening has a specific feature which makes it drastically different to loudspeaker listening and also to any natural sound environment. The audio is set directly to the left and right ear. Produced audio content is typically produced for loudspeaker playback. Therefore, the audio signals do not contain the properties and cues that our hearing system uses in spatial sound perception. That is the case unless binaural processing is introduced into the system.

Binaural processing, fundamentally, may be said to be a process that takes in input sound and modifies it so that it contains only such inter-aural and monaural properties that are perceptually correct (in respect to the way that our hearing system processes the spatial sound). The binaural processing is not a straightforward task and the existing solutions according to the state of the art have much sub-optimalities.

There is a large number of applications where binaural processing for music and movie playback is already included, such as media players and processing devices that are designed to transform multi-channel audio signals into the binaural counterpart for headphones. Typical approach is to use head-related transfer functions (HRTFs) to make virtual loudspeakers and add a room effect to the signal. This, in theory, could be equivalent to listening with loudspeakers in a specific room.

Practice has, however, repeatedly shown that this approach has not consistently satisfied the listeners. There seems to be a compromise that good spatialization with this straightforward method comes with the price of losing audio quality, such as having non-advantageous changes in sound color or timbre, annoying perception of room effect and loss of dynamics. Further problems include inaccurate localization (e.g. in-head localization, front-back-confusion), lack of spatial distance of the sound sources and inter-aural mismatch, i.e. auditory sensation near the ears due to wrong inter-aural cues.

Different listeners may judge the problems very differently. The sensitivity also varies depending on the input material, such as music (strict quality criteria in terms of sound color), movies (less strict) and games (even less strict, but localization is important). There are also typically different design goals depending on the content.

Therefore, the following description deals with an approach of overcoming the above problems as successfully as possible to maximize the averaged perceived overall quality.

Figure 9A:
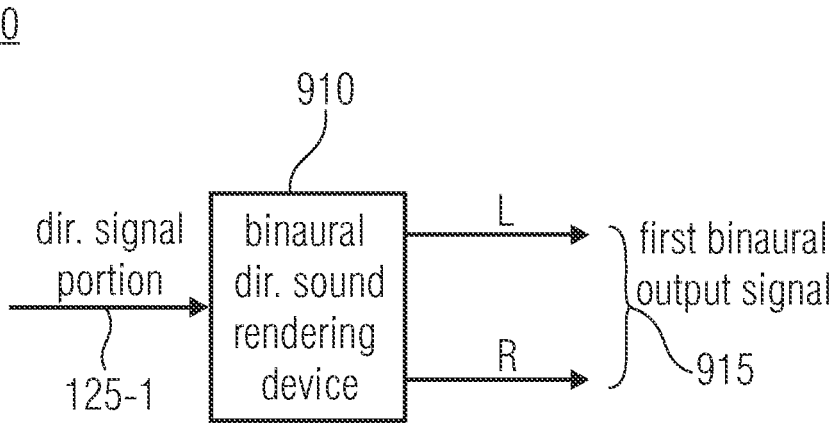
FIG. 9*a* is a block diagram of an overview of binaural direct sound rendering according to an embodiment of the present invention.

FIG. 9*a* shows a block diagram of an overview 900 of a binaural direct sound rendering device 910 according to further embodiments of the present invention. As shown in FIG. 9*a*, the binaural direct sound rendering device 910 is configured for processing the direct signal portion 125-1, which may be present at the output of the direct/ambience extractor 120 in the FIG. 1 embodiment, to obtain a first binaural output signal 915. The first binaural output signal 915 may comprise a left channel indicated by L and a right channel indicated by R.

Here, the binaural direct sound rendering device 910 may be configured to feed the direct signal portion 125-1 through head related transfer functions (HRTFs) to obtain a transformed direct signal portion. The binaural direct sound rendering device 910 may furthermore be configured to apply room effect to the transformed direct signal portion to finally obtain the first binaural output signal 915.

Figure 9B:
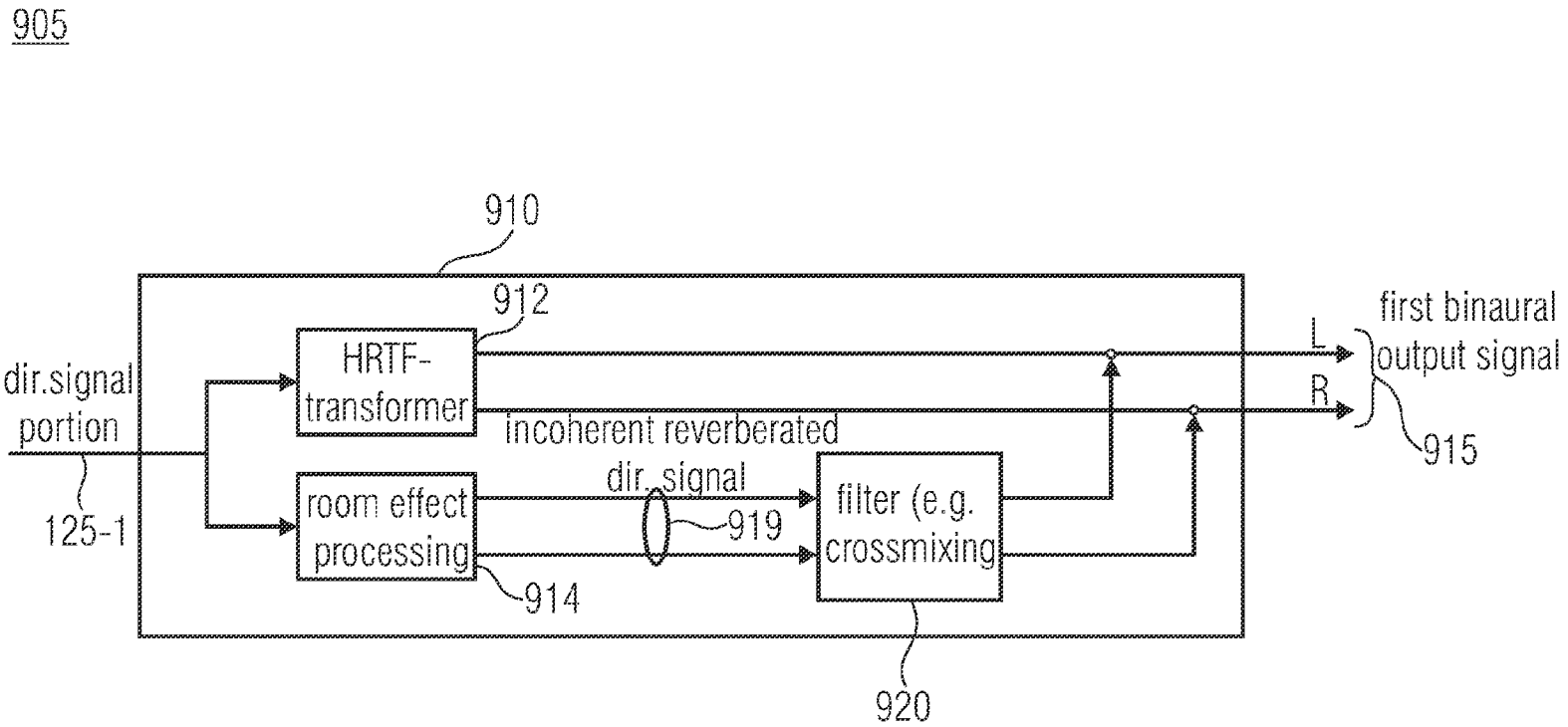
FIG. 9*b* is a block diagram of details of the binaural direct sound rendering of FIG. 9*a;*

FIG. 9*b* shows a block diagram of details 905 of the binaural direct sound rendering device 910 of FIG. 9*a*. The binaural direct sound rendering device 910 may comprise an "HRTF transformer" indicated by the block 912 and a room effect processing device (parallel reverb or simulation of early reflections) indicated by the block 914. As shown in FIG. 9*b*, the HRTF transformer 912 and the room effect processing device 914 may be operative on the direct signal portion 125-1 by applying the head related transfer functions (HRTFs) and room effect in parallel, so that the first binaural output signal 915 will be obtained.

Specifically, referring to FIG. 9*b*, this room effect processing can also provide an incoherent reverberated direct signal 919, which can be processed by a subsequent crossmixing filter 920 to adapt the signal to the interaural coherence of diffuse sound fields. Here, the combined output of the filter 920 and the HRTF transformer 912 constitutes the first binaural output signal 915. According to further embodiments, the room effect processing on the direct sound may also be a parametric representation of early reflections.

In embodiments, therefore, room effect can advantageously be applied in parallel to the HRTFs, and not serially (i.e. by applying room effect after feeding the signal through HRTFs). Specifically, only the sound that propagates directly from the source goes through or is transformed by the corresponding HRTFs. The indirect/reverberated sound can be approximated to enter the ears all around, i.e. in statistic fashion (by employing coherence control instead of HRTFs). There may also be serial implementations, but the parallel method is advantageous.

Figure 10A:
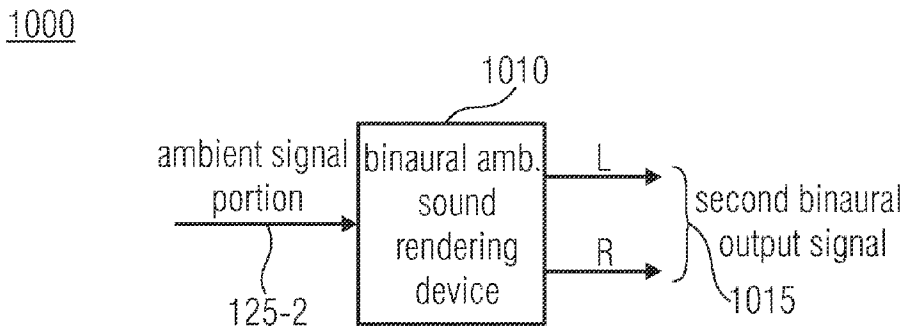
FIG. 10*a* is a block diagram of an overview of binaural ambient sound rendering according to an embodiment of the present invention.

FIG. 10*a* shows a block diagram of an overview 1000 of a binaural ambience sound rendering device 1010 according to further embodiments of the present invention. As shown in FIG. 10*a*, the binaural ambient sound rendering device 1010 may be configured for processing the ambient signal portion 125-2 output, for example, from the direct/ambience extractor 120 of FIG. 1, to obtain the second binaural output signal 1015. The second binaural output signal 1015 may also comprise a left channel (L) and a right channel (R).

Figure 10B:
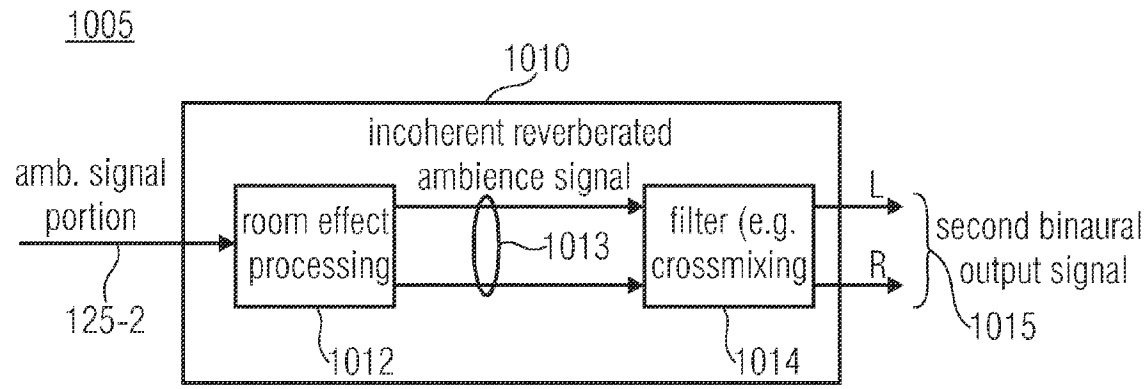
FIG. 10*b* is a block diagram of details of the binaural ambient sound rendering of details of the binaural ambient sound rendering of FIG. 10*a;*

FIG. 10*b* shows a block diagram of details 1005 of the binaural ambient sound rendering device 1010 of FIG. 10*a*. It can be seen in FIG. 10*b* that the binaural ambient sound rendering device 1010 may be configured to apply room effect as indicated by the block 1012 denoted by "room effect processing" to the ambient signal portion 125-2, such that an incoherent reverberated ambience signal 1013 will be obtained. The binaural ambience sound rendering device 1010 may furthermore be configured to process the incoherent reverberated ambience signal 1013 by applying a filter such as a crossmixing filter indicated by the block 1014, such that the second binaural output signal 1015 will be provided, the second binaural signal 1015 being adapted to interaural coherence of real diffuse sound fields. The block 1012 denoted by "room effect processing" may also be configured so that it directly produces the interaural coherence of real diffuse sound fields. In this case the block 1014 is not used.

According to a further embodiment, the binaural ambient sound rendering device 1010 is configured to apply room effect and/or a filter to the ambient signal portion 125-2 for providing the second binaural output signal 1015, so that the second binaural output signal 1015 will be adapted to interaural coherence of real diffuse sound fields.

In the above embodiments, decorrelation and coherence control may be performed in two consecutive steps, but this is not a requirement. It is also possible to achieve the same result with a single-step process, without an intermediate formulation of incoherent signals. Both methods are equally valid.

Figure 11:
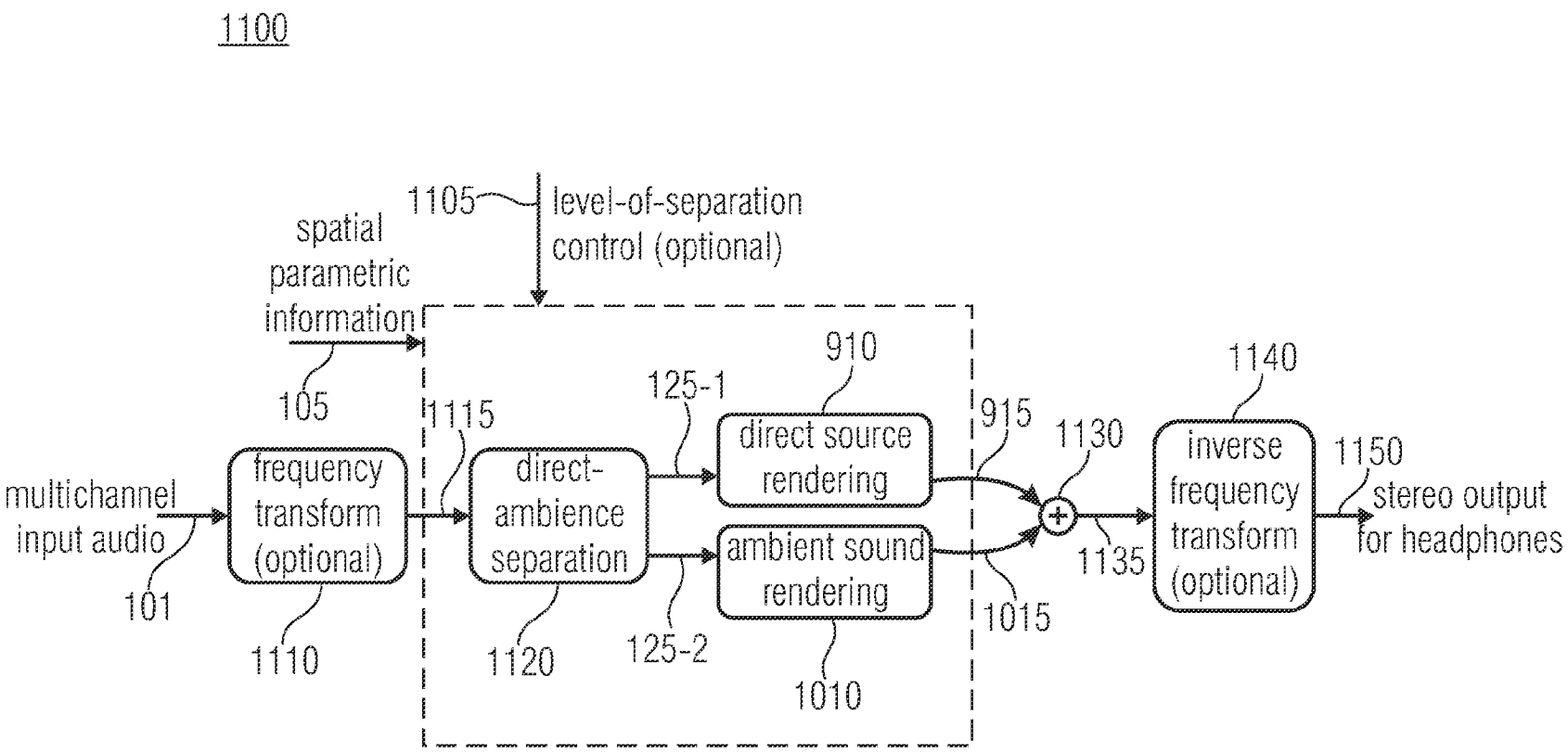
FIG. 11 is a conceptual block diagram of an embodiment of binaural reproduction of a multi-channel audio signal.

FIG. 11 shows a conceptual block diagram of an embodiment 1100 of binaural reproduction of a multi-channel input audio signal 101. Specifically, the embodiment of FIG. 11 represents an apparatus for a binaural reproduction of the multi-channel input audio signal 101, comprising a first converter 1110 ("frequency transform"), the separator 1120 ("direct-ambience separation"), the binaural direct sound rendering device 910 ("direct source rendering"), the binaural ambience sound rendering device 1010 ("ambient sound rendering"), the combiner 1130 as indicated by the 'plus' and a second converter 1140 ("inverse frequency transform"). In particular, the first converter 1110 may be configured for converting the multi-channel input audio signal 101 into a spectral representation 1115. The separator 1120 may be configured for extracting the direct signal portion 125-1 or the ambient signal portion 125-2 from the spectral representation 1115. Here, the separator 1120 may correspond to the apparatus 100 of FIG. 1, especially including the direct/ambience estimator 110 and the direct/ambience extractor 120 of the embodiment of FIG. 1. As explained before, the binaural direct sound rendering device 910 may be operative on the direct signal portion 125-1 to obtain the first binaural output signal 915. Correspondingly, the binaural ambient sound rendering device 1010 may be operative on the ambient signal portion 125-2 to obtain the second binaural output signal 1015. The combiner 1130 may be configured for combining the first binaural output signal 915 and the second binaural output signal 1015 to obtain a combined signal 1135. Finally, the second converter 1140 may be configured for converting the combined signal 1135 into a time domain to obtain a stereo output audio signal 1150 ("stereo output for headphones").

The frequency transform operation of the FIG. 11 embodiment illustrates that the system functions in a frequency transform domain, which is the native domain in perceptual processing of spatial audio. The system itself does not necessarily have a frequency transform if it is used as a add-on in a system that already functions in frequency transform domain.

The above direct/ambience separation process can be subdivided into two different parts. In the direct/ambience estimation part, the levels and/or ratios of the direct ambient part are estimated based on combination of a signal model and the properties of the audio signal. In the direct/ambience extraction part, the known ratios and the input signal can be used in creating the output direct in ambience signals.

Figure 12:
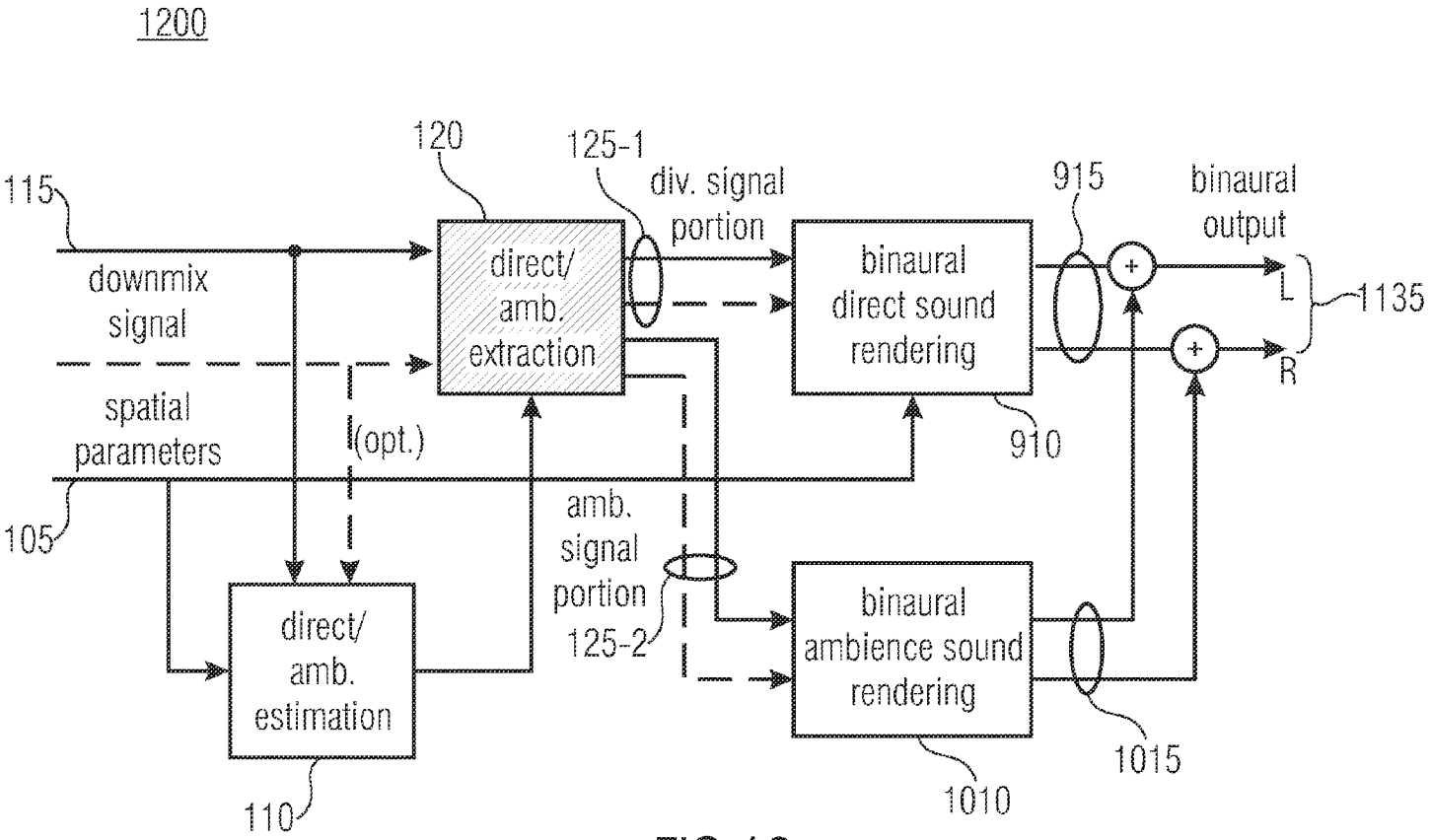
FIG. 12 is an overall block diagram of an embodiment of direct/ambience extraction including binaural reproduction.

Finally, FIG. 12 shows an overall block diagram of an embodiment 1200 of direct/ambience estimation/extraction including the use case of binaural reproduction. In particular, the embodiment 1200 of FIG. 12 may correspond to the embodiment 1100 of FIG. 11. However, in the embodiment 1200, the details of the separator 1120 of FIG. 11 corresponding to the blocks 110, 120 of the FIG. 1 embodiment are shown, which includes the estimation/extraction process based on the spatial parametric information 105. In addition, as opposed to the embodiment 1100 of FIG. 11, no conversion process between different domains is shown in the embodiment 1200 of FIG. 12. The blocks of the embodiment 1200 are also explicitly operative on the downmix signal 115, which can be derived from the multi-channel audio signal 101.

Figure 13A:
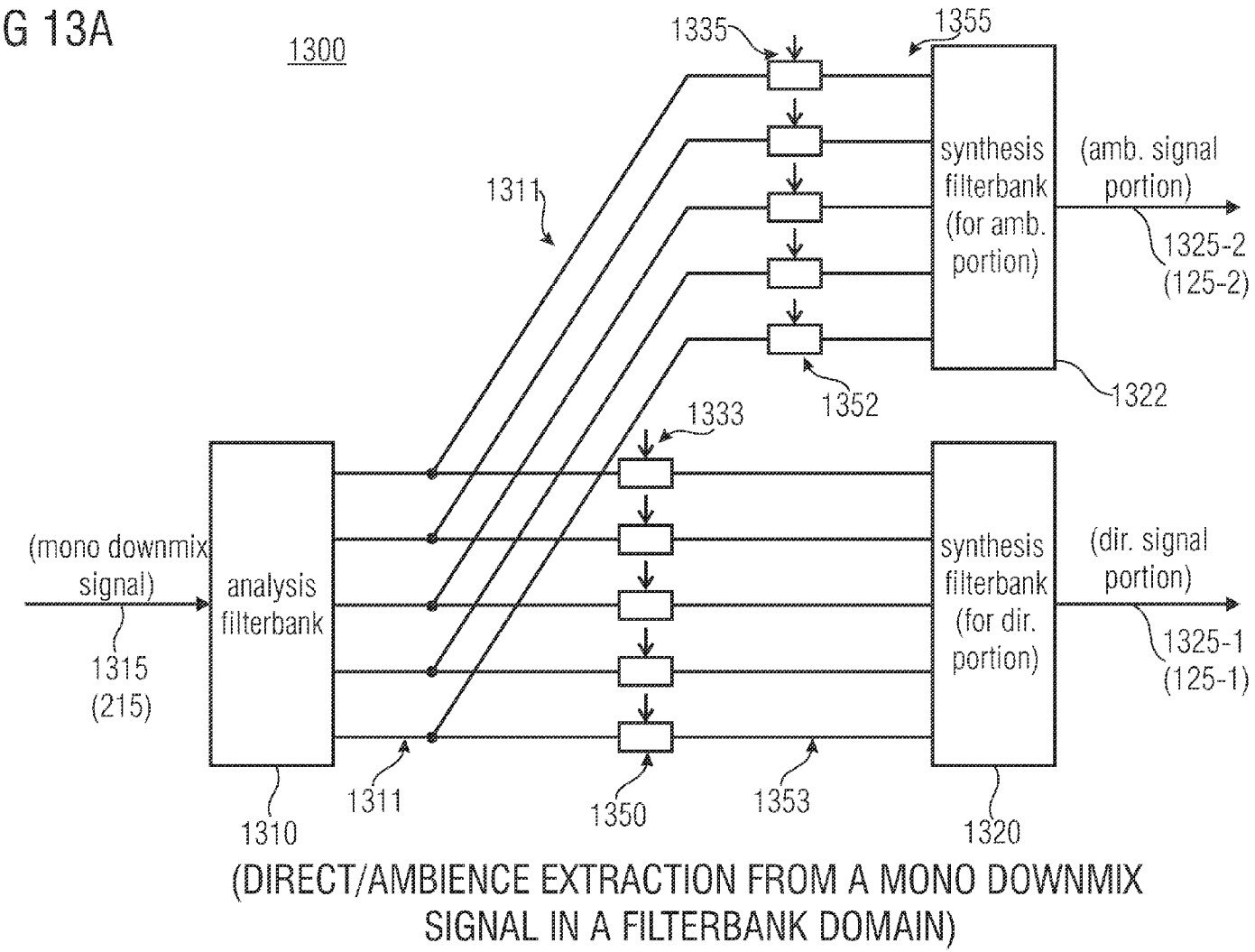
FIG. 13*a* is a block diagram of an embodiment of an apparatus for extracting a direct/ambient signal from a mono downmix signal in a filterbank domain.

FIG. 13*a* shows a block diagram of an embodiment of an apparatus 1300 for extracting a direct/ambient signal from a mono downmix signal in a filterbank domain. As shown in FIG. 13*a*, the apparatus 1300 comprises an analysis filterbank 1310, a synthesis filterbank 1320 for the direct portion and a synthesis filterbank 1322 for the ambient portion.

In particular, the analysis filterbank 1310 of the apparatus 1300 may be implemented to perform a short-time Fourier transform (STFT) or may, for example, be configured as an analysis QMF filterbank, while the synthesis filterbanks 1320, 1322 of the apparatus 1300 may be implemented to perform an inverse short-time Fourier transform (ISTFT) or may, for example, be configured as synthesis QMF filterbanks.

The analysis filterbank 1310 is configured for receiving a mono downmix signal 1315, which may correspond to the mono downmix signal 215 as shown in the FIG. 2 embodiment, and to convert the mono downmix signal 1315 into a plurality 1311 of filterbank subbands. As can be seen in FIG. 13*a*, the plurality 1311 of filterbank subbands is connected to a plurality 1350, 1352 of direct/ambience extraction blocks, respectively, wherein the plurality 1350, 1352 of direct/ambience extraction blocks is configured to apply $DTT_{mono}$- or $ATT_{mono}$-based parameters 1333, 1335 to the filterbank subbands, respectively.

Figure 13B:
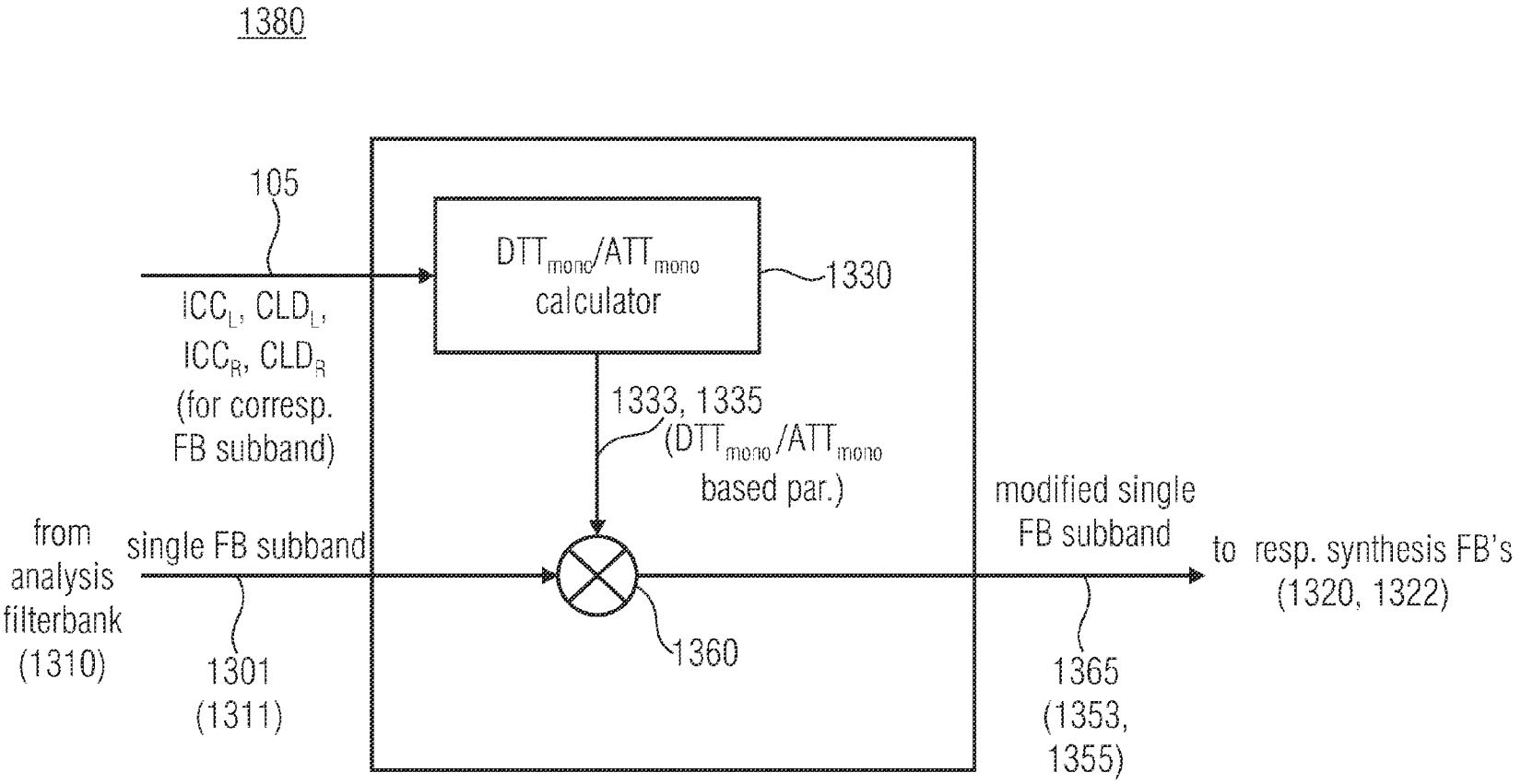
FIG. 13*b* is a block diagram of an embodiment of a direct/ambience extraction block of FIG. 13*a*.

The $DTT_{mono}$-, $ATT_{mono}$-based parameters 1333, 1335 may be supplied from a $DTT_{mono}$, $ATT_{mono}$ calculator 1330 as shown in FIG. 13*b*. In particular, the $DTT_{mono}$, $ATT_{mono}$ calculator 1330 of FIG. 13*b* may be configured to calculate the $DTT_{mono}$, $ATT_{mono}$ energy ratios or derive the $DTT_{mono}$-, $ATT_{mono}$-based parameters from the provided inter-channel coherence and channel level difference parameters ($ICC_L$, $CLD_L$, $ICC_R$, $CLD_R$) 105 corresponding to the left and the right channel (L, R) of a parametric stereo audio signal (e.g., the parametric stereo audio signal 201 of FIG. 2), which has been described correspondingly before. Here, for a single filterbank subband, the corresponding parameters 105 and $DTT_{mono}$-, $ATT_{mono}$-based parameters 1333, 1335 can be used. In this context, it is pointed out that those parameters are not constant over frequency.

As a result of the application of the $DTT_{mono}$- or $ATT_{mono}$-based parameters 1333, 1335, a plurality 1353, 1355 of modified filterbank subbands will be obtained, respectively. Subsequently, the plurality 1353, 1355 of modified filterbank subbands is fed into the synthesis filterbanks 1320, 1322, respectively, which are configured to synthesize the plurality 1353, 1355 of modified filterbank subbands so as to obtain the direct signal portion 1325-1 or the ambient signal portion 1325-2 of the mono downmix signal 1315, respectively. Here, the direct signal portion 1325-1 of FIG. 13*a* may correspond to the direct signal portion 125-1 of FIG. 2, while the ambient signal portion 1325-2 of FIG. 13*a* may correspond to the ambient signal portion 125-2 of FIG. 2.

Referring to FIG. 13*b*, a direct/ambience extraction block 1380 of the plurality 1350, 1352 of direct/ambience extraction blocks of FIG. 13*a* especially comprises the $DTT_{mono}$, $ATT_{mono}$ calculator 1330 and a multiplier 1360. The multiplier 1360 may be configured to multiply a single filterbank (FB) subband 1301 of the plurality of filterbank subbands 1311 with the corresponding $DTT_{mono}/ATT_{mono}$-based parameter 1333, 1335, so that a modified single filterbank subband 1365 of the plurality of filterbank subbands 1353, 1355 will be obtained. In particular, the direct/ambience extraction block 1380 is configured to apply the $DTT_{mono}$-based parameter in case the block 1380 belongs to the plurality 1350 of blocks, while it is configured to apply the $ATT_{mono}$-based parameter in case the block 1380 belongs to the plurality 1352 of blocks. The modified single filterbank subband 1365 can furthermore be supplied to the respective synthesis filterbank 1320, 1322 for the direct portion or the ambient portion.

According to embodiments, the spatial parameters and the derived parameters are given in a frequency resolution according to the critical bands of the human auditory system, e.g. 28 bands, which is normally less than the resolution of the filterbank.

Therefore, the direct/ambience extraction according to the FIG. 13*a* embodiment essentially operates on different subbands in a filterbank domain based on subband-wise calculated inter-channel coherence and channel level difference parameters, which may correspond to the inter-channel relation parameters 335 of FIG. 3*b*.

Figure 14:
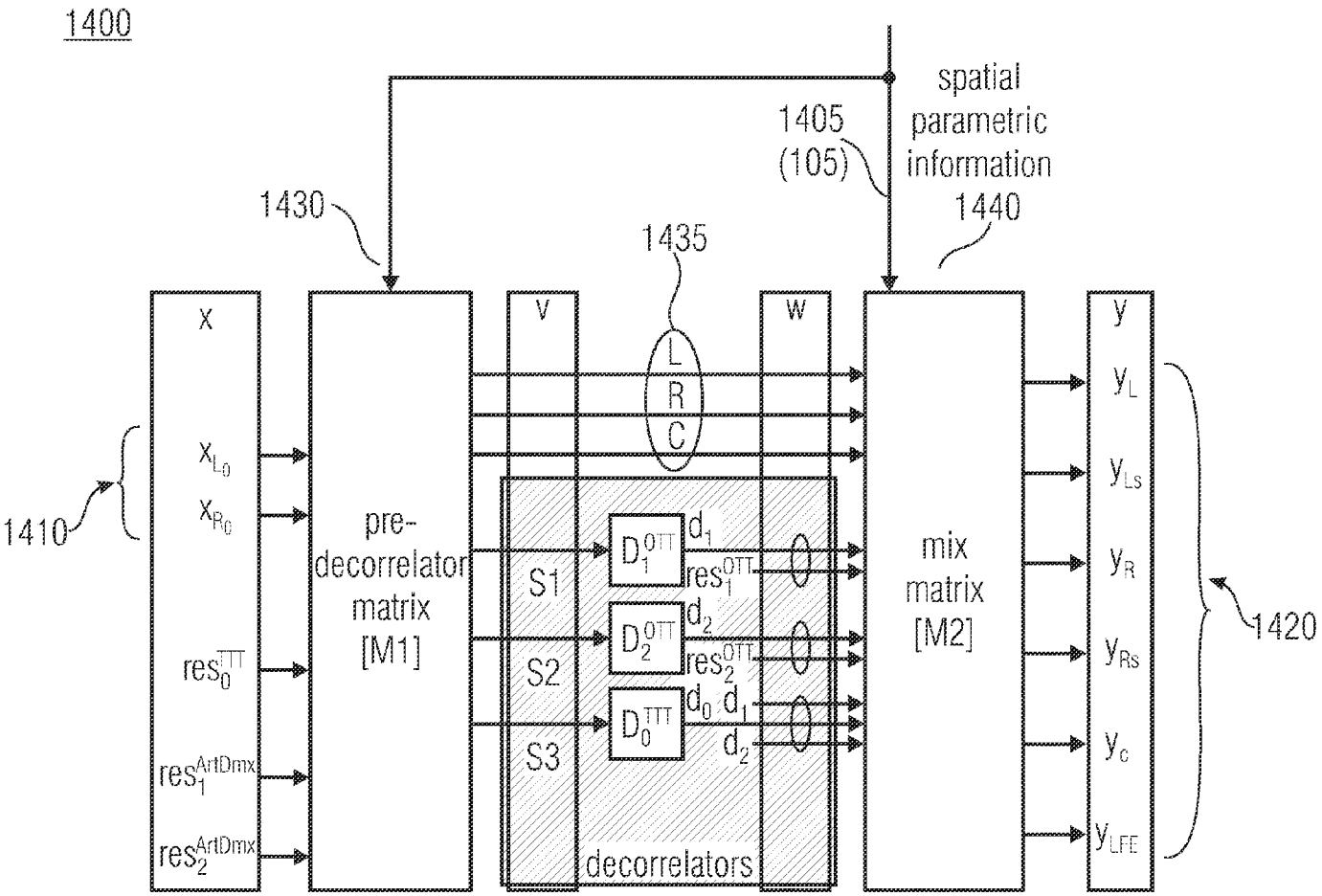
FIG. 14 is a schematic illustration of an exemplary MPEG Surround decoding scheme according to a further embodiment of the present invention.

FIG. 14 shows a schematic illustration of an exemplary MPEG Surround decoding scheme 1400 according to a further embodiment of the present invention. In particular, the FIG. 14 embodiment describes a decoding from a stereo downmix 1410 to six output channels 1420. Here, the signals denoted by "res" are residual signals, which are optional replacements for decorrelated signals (from the blocks denoted by "D"). According to the FIG. 14 embodiment, the spatial parametric information or inter-channel relation parameters (ICC, CLD) transmitted within an MPS stream from an encoder, such as the encoder 810 of FIG. 8 to a decoder, such as the decoder 820 of FIG. 8, may be used to generate decoding matrices 1430, 1440 denoted by "predecorrelator matrix M1" and "mix matrix M2", respectively. Specific to the embodiment of FIG. 14 is that the generation of the output channels 1420 (i.e. upmix channels L, LS, R, RS, C, LFE) from the side channels (L, R) and the center channel (C) (L, R, C 1435) by using the mix matrix M2 1440, is essentially determined by spatial parametric information 1405, which may correspond to the spatial parametric information 105 of FIG. 1, comprising particular inter-channel relation parameters (ICC, CLD) according to the MPS Surround Standard.

Here, a dividing of the left channel (L) into the corresponding output channels L, LS, the right channel (R) into the corresponding output channels R, RS and the center channel (C) into the corresponding output channels C, LFE, respectively, may be represented by a one-to-two (OTT) configuration having a respective input for the corresponding ICC, CLD parameters.

The exemplary MPEG Surround decoding scheme 1400 which specifically corresponds to a "5-2-5 configuration" may, for example, comprise the following steps. In a first step, the spatial parameters or parametric side information may be formulated into the decoding matrices 1430, 1440, which are shown in FIG. 14, according to the existing MPS Surround Standard. In a second step, the decoding matrices 1430, 1440 may be used in the parameter domain to provide inter-channel information of the upmix channels 1420. In a third step, with the thus provided inter-channel information, the direct/ambience energies of each upmix channel may be calculated. In a fourth step, the thus obtained direct/ambience energies may be downmixed to the number of downmix channels 1410. In a fifth step, weights that will be applied to the downmix channels 1410 can be calculated.

Before going further, it is to be pointed out that the just-mentioned exemplary process needs the measurement of $$E[|L_{dmx}|^2], E[|R_{dmx}|^2]$$

which are the mean powers of the downmix channels, and $$E[L_{dmx}R_{dmx}^*]$$

which may be referred to as the cross-spectrum, from the downmix channels. Here, the mean powers of the downmix channels are purposefully referred to as energies, since the term "mean power" is not a that common term to be used.

The expectation operator indicated by the square brackets can be replaced in practical applications by a time-average, recursive or non-recursive. The energies and the cross-spectrum are straight-forwardly measurable from the downmix signal.

It is also to be noted that the energy of a linear combination of two channels can be formulated from the energies of the channels, the mixing factors and the cross-spectrum (all in parametric domain, where no signal operations are needed). The linear combination $$Ch = aL_{dmx} + bR_{dmx}$$

has the following energy:

$$E[|Ch|^2] = E[|aL_{dmx} + bR_{dmx}|^2] = a^2E[|L_{dmx}|^2] + b^2E[|R_{dmx}|^2] + ab(E[L_{dmx}R^*_{dmx}] + E[R_{dmx}L^*_{dmx}]) = a^2E[|L_{dmx}|^2] + b^2E[|R_{dmx}|^2] + 2ab(Re\{E[L_{dmx}R^*_{dmx}]\})$$

The following describes the individual steps of the exemplary process (i.e. decoding scheme).

First Step (Spatial Parameters to Mixing Matrices)

As described before, the M1- and M2 matrices are created according to MPS Surround standard. The a:th row-b:th column element of M1 is M1(a,b).

Second Step (Mixing Matrices with Energies and Cross-Spectra of the Downmix to Inter-Channel Information of the Upmixed Channels)

Now we have the mixing matrices M1 and M2. We need to formulate how the output channels are created from the left downmix channel ($L_{dmx}$) and the right downmix channel ($R_{dmx}$). We assume that the decorrelators are used (FIG. 14, gray area). The decoding/upmixing in the MPS standard basically provides in the end the following formula for the overall input-output relation in the whole process:

$$L = a_L L_{dmx} b_L R_{dmx} + c_L D_1[S_1] + D_L D_2[S_2] e_L D_3[S_3]$$

The above is exemplary for the upmixed front left channel. The other channels can be formulated in the same way. The D-elements are the decorrelators, a-e are weights that are calculable from the M1 and M2 matrix entries.

In particular, the factors a-e are straight-forwardly formulable from the matrix entries:

$$a_L = \sum_{i=1}^{3} M1_{i,1} M2_{1,i}$$

-continued $$b_L = \sum_{i=1}^{3} M1_{i,2} M2_{1,i}$$

$$c_L = M2_{1,4}$$

$$d_L = M2_{1,5}$$

$$e_L = M2_{1,6}$$

and for the other channels accordingly.

The S-signals are $$S_n M1_{n+3,1} L_{dmx} + M1_{n+3,2} R_{dmx}$$

These S-signals are the inputs to the decorrelators from the left hand side matrix in FIG. 14. The energy $$E[|D[S_n]|^2] = E[|S_n|^2]$$

can be calculated as was explained above. The decorrelator does not affect the energy. A perceptually motivated way to do multichannel ambience extraction is by comparing a channel against the sum of all other channels. (Note that this is one option of many.) Now, if we exemplarily consider the case of the channel L, the rest of the channels reads:

$$X_L = \sum_{Ch=(REST)} a_{Ch} L_{dmx} + \sum_{Ch=(REST)} b_{Ch} R_{dmx} + \sum_{Ch=(REST)} c_{Ch} D_1[S_1] + \sum_{Ch=(REST)} d_{Ch} D_2[S_2] + \sum_{Ch=(REST)} e_{Ch} D_3[S_3]$$

We use the symbol "X" here because using "R" for "rest of the channels" might be confusing.

Then the energy of the channel L is $$E[|L|^2] = a_L^2 E[|L_{dmx}|^2] + b_L^2 E[|R_{dmx}|^2] + c_L^2 E[|S_1|^2] + d_L^2 E[|S_2|^2] + e_L^2 E[S_3|^2] + 2abRe\{E[L_{dmx}R^*_{dmx}]\}$$

Then the energy of the channel X is $$E[|X_L|^2] = \left(\sum_{Ch=(REST)} a_{Ch}\right)^2 E[|L_{dmx}|^2] + \left(\sum_{Ch=(REST)} b_{Ch}\right)^2 E[|R_{dmx}|^2] + \left(\sum_{Ch=(REST)} c_{Ch}\right)^2 E[|S_1|^2] + \left(\sum_{Ch=(REST)} d_{Ch}\right)^2 E[|S_2|^2] + \left(\sum_{Ch=(REST)} e_{Ch}\right)^2 E[|S_3|^2] + 2\left(\sum_{Ch=(REST)} a_{Ch} \sum_{Ch=(REST)} b_{Ch}\right) Re\{E[L_{dmx}R^*_{dmx}]\}$$

And the cross-spectrum is:

$$E[LX_L^*] = \sum_{Ch=(REST)} a_{Ch} a_L E[|L_{dmx}|^2] + \sum_{Ch=(REST)} b_{Ch} b_L E[|R_{dmx}|^2] + \sum_{Ch=(REST)} c_{Ch} c_L E[|S_1|^2] + \sum_{Ch=(REST)} d_{Ch} d_L E[|S_2|^2] + \sum_{Ch=(REST)} e_{Ch} e_L E[|S_3|^2] + \sum_{Ch=(REST)} a_L b_{Ch} E[L_{dmx}R^*_{dmx}] + \sum_{Ch=(REST)} a_{Ch} b_L E[L_{dmx}R^*_{dmx}]^*$$

Now we can formulate the ICC $$ICC_L = \frac{\mathrm{Re}\{E[LX_L^*]\}}{\sqrt{E[|L|^2]E[|X_L|^2]}}$$

and sigma $$\sigma_L = \frac{E[|L|^2]}{E[|X_L|^2]}$$

Third Step (Inter-Channel Information in the Upmixed Channels to DTT Parameters of the Upmixed Channels)

Now we can calculate the DTT of channel L according to $$DTT_L = \frac{1}{2}\left[\left(1 - \frac{1}{\sigma_L}\right) + \sqrt{\left(\frac{1}{\sigma_L} - 1\right)^2 + 4\frac{ICC_L^2}{\sigma_L}}\right]$$

The direct energy of L is $$E[|D_L|^2] = \mathrm{DTT} \cdot E[|L|^2]$$

The ambience energy of L is $$E[|A_L|^2] = (1 - \mathrm{DTT}) \cdot E[|L|^2]$$

Fourth Step (Downmixing the Direct/Ambient Energies)

If exemplarily using an incoherent downmixing rule, the left downmix channel ambience energy is $$E[|A_{Ldmx}|^2] = E[|A_L|^2] + E[|A_{Ls}|^2] + \frac{E[|A_C|^2] + E[|A_{LF}|^2]}{2}$$

and similarly for the direct part and the right channel direct and ambient part. Note that the above is just one downmixing rule. There can be other downmixing rules as well.

Fifth Step (Calculating the Weights for Ambience Extraction in Downmix Channels)

The left downmix DTT ratio is $$DTT_{Ldmx} = 1 - \frac{E[|A_{Ldmx}|^2]}{E[|L_{dmx}|^2]}$$

The weight factors can then be calculated as described in the FIG. 5 embodiment (i.e. by using the sqrt(DTT) or sqrt (1−DTT) approach) or as in the FIG. 6 embodiment (i.e. by using a crossmixing matrix method).

Basically, the above described exemplary process relates the CPC, ICC, and CLD parameters in the MPS stream to the ambience ratios of the downmix channels.

According to further embodiments, there are typically other means to achieve similar goals, and other conditions as well. For example, there may be other rules for downmixing, other loudspeaker layouts, other decoding methods and other ways to make the multi-channel ambience estimation than the one described previously, wherein a specific channel is compared to the remaining channels.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

The described embodiments are merely illustrative for the principles of the present invention. It is understood that modifications and variations of the arrangements and the details described herein will be apparent to others skilled in the art. It is the intent, therefore, to be limited only by the scope of the appending patent claims and not by the specific details presented by way of description and explanation of the embodiments herein.

Dependent on certain implementation requirements of the inventive methods, the inventive methods can be implemented in hardware or in software. The implementation can be performed using a digital storage medium, in particular, a disc, a DVD or a CD having electronically, readable control signals stored thereon, which co-operate with programmable computer systems, such that the inventive methods are performed. Generally, the present invention can, therefore, be implemented as a computer program product with the program code stored on a machine-readable carrier, the program code being operative for performing the inventive methods when the computer program product runs on a computer. In other words, the inventive methods are, therefore, a computer program having a program code for performing at least one of the inventive methods when the computer program runs on a computer. The inventive encoded audio signal can be stored on any machine-readable storage medium, such as a digital storage medium.

An advantage of the novel concept and technique is that the above-mentioned embodiments, i.e. apparatus, method or computer program, described in this application allow for estimating and extracting the direct and/or ambient components from an audio signal with aid of parametric spatial information. In particular, the novel processing of the present invention functions in frequency bands, as typically in the field of ambience extraction. The presented concept is relevant to audio signal processing, since there are a number of applications that need separation of direct and ambient components from an audio signal.

Opposed to standard ambience extraction methods, the present concept is not based on stereo input signals only and may also apply to mono downmix situations. For a single channel downmix, in general no inter-channel differences can be computed. However, by taking the spatial side information into account, ambience extraction becomes possible in this case also.

The present invention is advantageous in that it utilizes the spatial parameters to estimate the ambience levels of the "original" signal. It is based on the concept that the spatial parameters already contain information about the inter-channel differences of the "original" stereo or multi-channel signal.

Once the original stereo or multi-channel ambience levels are estimated, one can also derive the direct and ambience levels in the provided downmix channel(s). This may be done by linear combinations (i.e. weighted summation) of the ambience energies for ambience part, and direct energies or amplitudes for direct part. Therefore, embodiments of the present invention provide ambience estimation and extraction with aid of spatial side information.

Extending from this concept of side information-based processing, the following beneficial properties or advantages exist.

Embodiments of the present invention provide ambience estimation with aid of spatial side information and the provided downmix channels. Such and ambience estimation is important in cases when there are more than one downmix channel provided along with the side information. The side information, and the information that is measured from the downmix channels, can be used together in ambience estimation. In MPEG surround with a stereo downmix, these two information sources together provide the complete information of the inter-channel relations of the original multi-channel sound, and the ambience estimation is based on these relations.

Embodiments of the present invention also provide downmixing of the direct and ambient energies. In the described situation of side-information based ambience extraction, there is an intermediate step of estimating the ambience in a number of channels higher than the provided downmix channels. Therefore, this ambience information has to be mapped to the number of downmix audio channels in a valid way. This process can be referred to as downmixing due to its correspondence to audio channel downmixing. This may be most straightforwardly done by combining the direct and ambience energy in the same way as the provided downmix channels were downmixed.

The downmixing rule does not have one ideal solution, but is likely to be dependent on the application. For instance, in MPEG surround it can be beneficial to treat the channels differently (center, front loud speakers, rear loud speakers) due to their typically different signal content.

Moreover, embodiments provide a multi-channel ambience estimation independently in each channel in respect to the other channels. This property/approach allows to simply use the presented stereo ambience estimation formula to each channel relative to all other channels. By this measure, it is not necessary to assume equal ambience level in all channels. The presented approach is based on the assumption about spatial perception that the ambient component in each channel is that component which has an incoherent counterpart in some of all other channels. An example that suggest the validity of this assumption is that one of two channels emitting noise (ambience) can be divided further into two channels with half energy each, without affecting the perceived sound scene significantly.

In terms of signal processing, it is advantageous that the actual direct/ambience ratio estimation happens by applying the presented ambience estimation formula to each channel versus the linear combination of all other channels.

Finally, embodiments provide an application of the estimated direct ambience energies to extract the actual signals. Once the ambience levels in the downmix channels are known, one may apply two inventive methods for obtaining the ambience signals. The first method is based on a simple multiplication, wherein the direct and ambient parts for each downmix channel can be generated by multiplying the signal with sqrt (direct-to-total-energy-ratio) and sqrt (ambient-to-total-energy-ratio). This provides for each downmix channel two signals that are coherent to each other, but have the energies that the direct and ambient part were estimated to have.

The second method is based on a least-mean-square solution with crossmixing of the channels, wherein the channel crossmixing (also possible with negative signs) allows better estimation of the direct ambience signals than the above solution. In contrast to a least means solution for stereo input and equal ambient levels in the channels provided in "Multiple-loudspeaker playback of stereo signals", C. Faller, Journal of the AES, October 2007 and "Patent application title: Method to Generate Multi-Channel Audio Signal from Stereo Signals", Inventors: Christof Faller, Agents: FISH & RICHARDSON P.C., Assignees: LG ELECTRONICS, INC., Origin: MINNEAPOLIS, Minn. US, IPC8 Class: AH04R500FI, USPC Class: 381 1, the present invention provides a least-mean-square solution that does not require equal ambience levels and is also extendable to any number of channels.

Additional properties of the novel processing are the following. In the ambience processing for binaural rendering, the ambience can be processed with a filter that has the property of providing inter-aural coherence in frequency bands that is similar to the inter-aural coherence in real diffuse sound fields, wherein the filter may also include room effect. In the direct part processing for binaural rendering, the direct part can be fed through head related transfer functions (HRTFs) with possible addition of room effect, such as early reflections and/or reverberation.

Besides this, a "level-of-separation" control corresponding to a dry/wet control may be realized in further embodiments. In particular, full separation may not be desirable in many applications as it may lead to audible artifacts, like abrupt changes, modulation effects, etc. Therefore, all the relevant parts of the described processes can be implemented with a "level-of-separation" control for controlling the amount of desired and useful separation. With regard to FIG. 11, such a level-of-separation control is indicated by a control input 1105 of a dashed box for controlling the direct/ambience separation 1120 and/or the binaural rendering devices 910, 1010, respectively. This control may work similar to a dry/wet control in audio effects processing.

The main benefits of the presented solution are the following. The system works in all situations, also with parametric stereo and MPEG surround with mono downmix, unlike previous solutions that rely on downmix information only. The system is furthermore able to utilize spatial side information conveyed together with the audio signal in spatial audio bitstreams to more accurately estimate direct and ambience energies than with simple inter-channel analysis of the downmix channels. Therefore, many applications, such as binaural processing, may benefit by applying different processing for direct and ambient parts of the sound.

Embodiments are based on the following psychoacoustic assumptions. Human auditory systems localizes sources based on inter-aural cues in time-frequency tiles (areas restricted into certain frequency and time range). If two or more incoherent concurrent sources which overlap in time and frequency are presented simultaneously in different locations, the hearing system is not able to perceive the location of the sources. This is because the sum of these sources does not produce reliable inter-aural cues on the listener. The hearing system my thus be described so that it picks up from the audio scene closed time-frequency tiles that provide reliable localization information, and treats the rest as unlocalizable. By these means the hearing system is able to localize sources in complex sound environments. Simultaneous coherent sources have a different effect, they form approximately the same inter-aural cues that a single source between the coherent sources would form.

This is also the property that embodiments take advantage of. The level of localizable (direct) and unlocalizable (ambience) sound can be estimated and these components will then be extracted. The spatialization signal processing is applied only to the localizable/direct part, while the diffuseness/spaciousness/envelope processing is applied to the unlocalizable/ambient part. This gives a significant benefit in the design of a binaural processing system, since many processes may be applied only there where they are needed, leaving the remaining signal unaffected. All processing happens in frequency bands that approximate the human hearing frequency resolution.

Embodiments are based on a decomposition of the signal to maximize the perceptual quality, but minimize the perceived problems. By such a decomposition, it is possible to obtain the direct and the ambience component of an audio signal separately. The two components can then be further processed to achieve a desired effect or representation.

Specifically, embodiments of the present invention allow ambience estimation with aid of the spatial side information in the coded domain.

The present invention is also advantageous in that typical problems of headphone reproduction of audio signals can be reduced by separating the signals in a direct and ambient signal. Embodiments allow to improve existing direct/ambience extraction methods to be applied to binaural sound rendering for headphone reproduction.

The main use case of the spatial side information based processing is naturally MPEG surround and parametric stereo (and similar parametric coding techniques). Typical applications which benefit from ambience extraction are binaural playback due to the ability to apply a different extent of room effect to different parts of the sound, and upmixing to a higher number of channels due to the ability to position and process different components of the sound differently. There may also be applications where the user would need modification of the direct/ambience level, e.g. for purpose of enhancing speech intelligibility.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for extracting a direct and/or ambience signal from a downmix signal and spatial parametric information, the downmix signal and the spatial parametric information representing a multi-channel audio signal comprising more channels than the downmix signal, wherein the spatial parametric information comprises inter-channel relations of the multi-channel audio signal, the apparatus comprising:

a direct/ambience estimator configured to estimate a direct level information of a direct portion of the multi-channel audio signal and/or for estimating an ambience level information of an ambient portion of the multi-channel audio signal based on the spatial parametric information; and a direct/ambience extractor configured to extract a direct signal portion and/or an ambient signal portion from the downmix signal based on the estimated direct level information of the direct portion or based on the estimated ambience level information of the ambient portion, wherein the direct/ambience extractor is configured to downmix the estimated direct level information of the direct portion or the estimated ambience level information of the ambient portion to acquire downmixed level information of the direct portion or the ambient portion and extract the direct signal portion or the ambient signal portion from the downmix signal based on the downmixed level information.

2. The apparatus according to claim 1, wherein the direct/ambience extractor is furthermore configured to perform a downmix of the estimated direct level information of the direct portion or the estimated ambience level information of the ambient portion by combining the estimated direct level information of the direct portion with coherent summation and the estimated ambience level information of the ambient portion with incoherent summation.

3. The apparatus according to claim 1, wherein the direct/ambience extractor is furthermore configured to derive gain parameters from the downmixed level information of the direct portion or the ambient portion and apply the derived gain parameters to the downmix signal to acquire the direct signal portion or the ambient signal portion.

4. The apparatus according to claim 3, wherein the direct/ambience extractor is furthermore configured to determine a direct-to-total or an ambient-to-total energy ratio from the downmixed level information of the direct portion or the ambient portion and use as the gain parameters extraction parameters based on the determined DTT or ATT energy ratio.

5. The apparatus according to claim 1, wherein the direct/ambience extractor is configured to extract the direct signal portion or the ambient signal portion by applying a quadratic M-by-M extraction matrix to the downmix signal, wherein a size of the quadratic M-by-M extraction matrix corresponds to a number of downmix channels.

6. The apparatus according to claim 5, wherein the direct/ambience extractor is furthermore configured to apply a first plurality of extraction parameters to the downmix signal to acquire the direct signal portion and a second plurality of extraction parameters to the downmix signal to acquire the ambient signal portion, the first and the second plurality of extraction parameters constituting a diagonal matrix.

7. The apparatus according to claim 1, wherein the direct/ambience estimator is configured to estimate the direct level information of the direct portion of the multi-channel audio signal or to estimate the ambience level information of the ambient portion of the multi-channel audio signal based on the spatial parametric information and at least two downmix channels of the downmix signal received by the direct/ambience estimator.

8. The apparatus according to claim 1, wherein the direct/ambience estimator is configured to apply a stereo ambience estimation formula using the spatial parametric information for each channel of the multi-channel audio signal, wherein the stereo ambience estimation formula is given by $$\mathrm{DTT}_i = f_{DTT}[\sigma_i(Ch_i,R), \mathrm{ICC}_i(Ch_i,R)],$$

$$\mathrm{ATT}_i = 1 - \mathrm{DTT}_i$$

depending on a channel level difference, which is a decibel value of $\sigma_i$, and an inter-channel coherence parameter of the channel $\mathrm{Ch}_i$, and wherein R is a linear combination of remaining channels.

9. The apparatus according to claim 1, wherein the direct/ambience extractor is configured to extract the direct signal portion or the ambient signal portion by a least-mean-square solution with channel crossmixing, the LMS solution not needing equal ambience levels.

10. The apparatus according to claim 8, wherein the direct/ambience extractor is configured to derive the LMS solution by assuming a signal model, such that the LMS solution is not restricted to a stereo channel downmix signal.

11. The apparatus according to claim 1, the apparatus further comprising:

a binaural direct sound rendering device configured to process the direct signal portion to acquire a first binaural output signal;

a binaural ambient sound rendering device configured to process the ambient signal portion to acquire a second binaural output signal; and a combiner configured to combine the first and the second binaural output signal to acquire a combined binaural output signal.

12. The apparatus according to claim 11, wherein the binaural ambient sound rendering device is configured to apply room effect and/or a filter to the ambient signal portion to provide the second binaural output signal, the second binaural output signal being adapted to inter-aural coherence of real diffuse sound fields.

13. The apparatus according to claim 11, wherein the binaural direct sound rendering device is configured to feed the direct signal portion through filters based on head-related transfer functions to acquire the first binaural output signal.

14. A method for extracting a direct and/or ambience signal from a downmix signal and spatial parametric information, the downmix signal and the spatial parametric information representing a multi-channel audio signal comprising more channels than the downmix signal, wherein the spatial parametric information comprises inter-channel relations of the multi-channel audio signal, the method comprising:

estimating a direct level information of a direct portion of the multi-channel audio signal and/or estimating an ambience level information of an ambient portion of the multi-channel audio signal based on the spatial parametric information; and extracting a direct signal portion and/or an ambient signal portion from the downmix signal based on the estimated direct level information of the direct portion or based on the estimated ambience level information of the ambient portion; wherein the extracting includes downmixing the estimated direct level information of the direct portion or the estimated ambience level information of the ambient portion to acquire downmixed level information of the direct portion or the ambient portion and extracting the direct signal portion or the ambient signal portion from the downmix signal based on the downmixed level information.

15. A non-transitory computer readable medium including a computer program comprising a program code for performing, when the computer program is executed on a computer, the method of extracting a direct and/or ambience signal from a downmix signal and spatial parametric information, the downmix signal and the spatial parametric information representing a multi-channel audio signal comprising more channels than the downmix signal, wherein the spatial parametric information comprises inter-channel relations of the multi-channel audio signal, the method comprising:

estimating a direct level information of a direct portion of the multi-channel audio signal and/or estimating an ambience level information of an ambient portion of the multi-channel audio signal based on the spatial parametric information; and extracting a direct signal portion and/or an ambient signal portion from the downmix signal based on the estimated direct level information of the direct portion or based on the estimated ambience level information of the ambient portion; wherein the extracting includes downmixing the estimated direct level information of the direct portion or the estimated ambience level information of the ambient portion to acquire downmixed level information of the direct portion or the ambient portion and extracting the direct signal portion or the ambient signal portion from the downmix signal based on the downmixed level information.

16. An apparatus for extracting a direct and/or ambience signal from a downmix signal and spatial parametric information, the downmix signal and the spatial parametric information representing a multi-channel audio signal comprising more channels than the downmix signal, wherein the spatial parametric information comprises inter-channel relations of the multi-channel audio signal, the apparatus comprising:

a direct/ambience estimator configured to estimate a direct level information of a direct portion of the multi-channel audio signal and/or for estimating an ambience level information of an ambient portion of the multi-channel audio signal based on the spatial parametric information; and a direct/ambience extractor configured to extract a direct signal portion and/or an ambient signal portion from the downmix signal based on the estimated direct level information of the direct portion or based on the estimated ambience level information of the ambient portion; wherein the direct/ambience estimator is configured to estimate the direct level information of the direct portion of the multi-channel audio signal or to estimate the ambience level information of the ambient portion of the multi-channel audio signal based on the spatial parametric information and at least two downmix channels of the downmix signal received by the direct/ambience estimator.

17. A method for extracting a direct and/or ambience signal from a downmix signal and spatial parametric information, the downmix signal and the spatial parametric information representing a multi-channel audio signal comprising more channels than the downmix signal, wherein the spatial parametric information comprises inter-channel relations of the multi-channel audio signal, the method comprising:

estimating a direct level information of a direct portion of the multi-channel audio signal and/or estimating an ambience level information of an ambient portion of the multi-channel audio signal based on the spatial parametric information; and extracting a direct signal portion and/or an ambient signal portion from the downmix signal based on the estimated direct level information of the direct portion or based on the estimated ambience level information of the ambient portion; wherein the estimating includes estimating the direct level information of the direct portion of the multi-channel audio signal or estimating the ambience level information of the ambient portion of the multi-channel audio signal based on the spatial parametric information and at least two downmix channels of the downmix signal.

18. A non-transitory computer readable medium including a computer program comprising a program code for performing, when the computer program is executed on a computer, the method of extracting a direct and/or ambience signal from a downmix signal and spatial parametric information, the downmix signal and the spatial parametric information representing a multi-channel audio signal comprising more channels than the downmix signal, wherein the spatial parametric information comprises inter-channel relations of the multi-channel audio signal, the method comprising:

estimating a direct level information of a direct portion of the multi-channel audio signal and/or estimating an ambience level information of an ambient portion of the multi-channel audio signal based on the spatial parametric information; and extracting a direct signal portion and/or an ambient signal portion from the downmix signal based on the estimated direct level information of the direct portion or based on the estimated ambience level information of the ambient portion; wherein the estimating includes estimating the direct level information of the direct portion of the multi-channel audio signal or estimating the ambience level information of the ambient portion of the multi-channel audio signal based on the spatial parametric information and at least two downmix channels of the downmix signal.

* * * * *